US007587877B2

(12) United States Patent
Strickland et al.

(10) Patent No.: US 7,587,877 B2
(45) Date of Patent: Sep. 15, 2009

(54) COLD-FORMED STEEL JOISTS

(75) Inventors: Michael Richard Strickland, Richmond Hill (CA); Lei Xu, Waterloo (CA)

(73) Assignee: Best Joist Inc, Richmond Hill, ON (CA)

( * ) Notice: Subject to any disclaimer, the term of this patent is extended or adjusted under 35 U.S.C. 154(b) by 709 days.

(21) Appl. No.: 10/974,964

(22) Filed: Oct. 28, 2004

(65) Prior Publication Data

US 2005/0144892 A1 Jul. 7, 2005

Related U.S. Application Data

(63) Continuation-in-part of application No. 10/721,610, filed on Nov. 25, 2003, now abandoned.

(60) Provisional application No. 60/514,622, filed on Oct. 28, 2003.

(51) Int. Cl.

| | |
|---|---|
| ***E04C 3/00*** | (2006.01) |
| ***E04C 3/02*** | (2006.01) |
| ***E04B 1/18*** | (2006.01) |
| ***E04H 12/00*** | (2006.01) |

(52) U.S. Cl. ..... 52/837; 52/634; 52/638; 52/650.2; 52/693; 52/831

(58) Field of Classification Search ..... 52/729.1, 52/729.3, 729.5, 724.3, 638, 650.2, 634, 52/846, 693

See application file for complete search history.

(56) References Cited

U.S. PATENT DOCUMENTS

| | | | | | |
|---|---|---|---|---|---|
| 2,088,781 | A | * | 8/1937 | Folsom | 52/634 |
| 2,108,373 | A | | 2/1938 | Greulich | |
| 2,169,253 | A | * | 8/1939 | Kotrbaty | 52/693 |
| 3,349,535 | A | * | 10/1967 | Balinski | 52/634 |
| 3,483,665 | A | * | 12/1969 | Miller | 52/461 |
| 3,942,297 | A | * | 3/1976 | Kitagawa | 52/637 |
| 4,432,178 | A | | 2/1984 | Taft | |
| 4,691,494 | A | * | 9/1987 | Gwynne | 52/842 |
| 4,793,113 | A | * | 12/1988 | Bodnar | 52/481.1 |
| 4,947,612 | A | * | 8/1990 | Taylor et al. | 52/693 |
| 4,986,051 | A | * | 1/1991 | Meyer et al. | 14/74.5 |
| 5,207,045 | A | * | 5/1993 | Bodnar | 52/600 |
| 5,230,190 | A | * | 7/1993 | Schuette | 52/220.1 |
| 5,301,486 | A | * | 4/1994 | Taylor | 52/695 |
| 5,417,028 | A | * | 5/1995 | Meyer | 52/846 |
| 5,527,625 | A | * | 6/1996 | Bodnar | 428/595 |
| 5,546,716 | A | * | 8/1996 | Broxterman et al. | 52/220.1 |

(Continued)

FOREIGN PATENT DOCUMENTS

| | | |
|---|---|---|
| AU | 79/47479 A1 | 3/1979 |

(Continued)

*Primary Examiner*—Richard E Chilcot, Jr.
*Assistant Examiner*—Andrew J Triggs
(74) *Attorney, Agent, or Firm*—Nancy E. Hill; Hill & Schumacher

(57) ABSTRACT

A joist comprised of at least one cold-formed steel elongated chord member; a cold-formed steel web having a plurality of web members and means for securing said web to said chord member. A plurality of joists are generally for use in a support system for a platform or a deck in the construction of floors and roofs. The support system is of particular use in a composite floor and roof systems.

53 Claims, 26 Drawing Sheets

U.S. PATENT DOCUMENTS

| | | | | |
|---|---|---|---|---|
| 5,771,653 | A * | 6/1998 | Dolati et al. | 52/846 |
| 6,073,414 | A * | 6/2000 | Garris et al. | 52/694 |
| 6,170,217 | B1 * | 1/2001 | Meyer | 52/693 |
| 6,301,857 | B1 * | 10/2001 | Vrana | 52/730.1 |
| 6,457,292 | B1 * | 10/2002 | Vrana | 52/729.5 |
| 6,519,908 | B1 * | 2/2003 | Masterson et al. | 52/696 |
| 6,658,809 | B2 * | 12/2003 | Collins | 52/639 |
| 6,708,459 | B2 * | 3/2004 | Bodnar | 52/356 |
| 6,874,294 | B2 * | 4/2005 | Masterson et al. | 52/696 |
| 6,964,140 | B2 * | 11/2005 | Walker et al. | 52/715 |
| 7,093,401 | B2 * | 8/2006 | Collins | 52/846 |
| 7,107,730 | B2 * | 9/2006 | Park | 52/223.8 |
| 7,231,746 | B2 * | 6/2007 | Bodnar | 52/726.2 |
| 7,409,804 | B2 * | 8/2008 | Moody et al. | 52/639 |
| 2002/0020138 | A1 * | 2/2002 | Walker et al. | 52/715 |
| 2002/0046534 | A1 | 4/2002 | Heinly et al. | |
| 2002/0069606 | A1 | 6/2002 | Gosselin et al. | |
| 2002/0144484 | A1 * | 10/2002 | Vrana | 52/729.5 |
| 2003/0014935 | A1 * | 1/2003 | Bodnar | 52/481.1 |
| 2003/0061780 | A1 * | 4/2003 | Masterson et al. | 52/702 |
| 2003/0084637 | A1 | 5/2003 | Daudet | |
| 2005/0102962 | A1 * | 5/2005 | McInerney et al. | 52/729.3 |

FOREIGN PATENT DOCUMENTS

| | | | |
|---|---|---|---|
| AU | 80/59157 | A1 | 6/1980 |
| AU | 84/31873 | B | 8/1984 |
| AU | 199714733 | A1 | 2/1997 |
| AU | 199948840 | B2 | 9/1999 |
| AU | 199952660 | A1 | 10/1999 |
| AU | 2004100666 | A4 | 8/2004 |
| CA | 900867 | | 5/1972 |
| CA | 1172463 | | 8/1984 |
| CA | 2412726 | | 1/2002 |
| WO | 00/46459 | | 8/2000 |
| WO | 02/01016 | A1 | 1/2002 |
| WO | 03/057931 | A2 | 7/2003 |
| WO | 2004/038123 | | 5/2004 |

* cited by examiner

COLD-FORMED STEEL JOISTS

CROSS REFERENCE TO RELATED PATENT APPLICATION

This patent application relates to U.S. Provisional Patent Application Ser. No. 60/514,622 filed on Oct. 28, 2003 entitled SINGLE WEB COLD FORMED JOIST and U.S. patent application Ser. No. 10/721,610 filed on Nov. 25, 2003 entitled SEGMENTED COLD FORMED JOIST.

FIELD OF INVENTION

This invention relates to cold-formed steel joists and to assemblies of such joists to provide structural support for floors and roofs in the building construction industry, such as support including fire rated steel-concrete composite structures. Both top chord and bottom chord supported joists are included as aspects of the said invention.

BACKGROUND OF INVENTION

Joists are commonly used in the construction industry to span a distance between opposing walls and provide a structural support for a floor, roof or the like. Joists can be comprised of a variety of materials including softwood, wood based laminates, and metal, particularly steel.

Steel joists can be constructed in an open web configuration, which generally consists of spaced apart upper and lower chord members which extend longitudinally thereof and are fastened together by a zig-zag web. Such open web joists are typically manufactured from hot-rolled steel structural members namely the upper and lower chords and the webs. The webs typically can be comprised of hot-rolled steel rods, which are formed into a zig-zagged pattern and welded to the upper and lower chords. Integral parts of the web are the end angled supports that connect the ends of the lower chord to the upper chord to counter load stresses at the ends of the joist. Open web joists are normally top chord bearing meaning that they are supported by the underside of the top chord, so that the top chord extends longitudinally beyond the bottom chord and the end angle supports to provide bearing interface with the opposing walls.

Open web joists are by their nature highly customizable in terms of their load bearing capabilities. Both chords and the zig-zag web can be made from different thickness of steel, and the members constituting the zig-zag web can vary in thickness along the length of the joist. The webs are open in the sense that there is a space between the rods longitudinally along the central web section that can receive utilities such as wires, pipe work, air ducts or the like. Open web joists can be concentric, meaning that the load being supported exerts forces that substantially pass through the centres of gravity of the joists. If the joists are loaded otherwise, they are termed eccentric.

The joist industry has introduced various types of composite steel-concrete non-combustible floor and roof systems for the construction industry, in which the top chords are embedded into a concrete slab, such a slab having both load bearing and fire resistant properties. Examples of composite joists can be found in U.S. Pat. Nos. 5,941,035, 4,741,138, 4,454,695 and U.S. Publication No. 2002/0069606 A1. A composite joist design permits the top chord member of a joist to be designed with less steel in comparison with non-composite systems since the concrete slab when properly bonded to the upper steel joist provides additional load support for the floor or roof system.

Generally speaking, for a structural joist member to be composite it must have means to mechanically interlock with the concrete to provide sheer bonding. It is generally difficult and costly to design steel and concrete composite floors using steel joists. Simply affixing vertical studs to the top chord is forbidden by safety regulations in many jurisdictions which state that structural members cannot have objects extending above a structural floor member that will encumber the walking path of a worker.

The methods for providing sheer bonding between the joist and the concrete in a composite joist are generally expensive to produce in the prior art.

Furthermore, camber (defined as a slight arch added to the joist) has been introduced into the open web joist technology to offset the deflection associated with dead loads such that only the live load deflection of the joist needs to be accounted for in designs of the joist. However large machines or jigs are needed to impart the camber to the chords of the joist where typically the web resists the cambering process.

Moreover, hot-rolled open web joists are typically coated or finished with a coloured primer. Steel joists manufacturers typically use large tanks of paint into which completed welded joist assemblies are dipped to receive a coating of primer paint. However, the process has become more expensive due to environmental considerations when using dipped tanks containing volatile solvents.

Furthermore construction with open web joists is dependent on skilled labour which in many instances sets the critical path schedule on many construction projects during busy construction season periods when skilled labour is in highest demand. Because both the manufacture and usage in construction are labour intensive, open web steel joists are costly, so that their use is viable only in larger commercial and industrial structures requiring spans near 40 feet and above.

An alternative approach to the open web steel joist is the cold-formed steel joist. Cold-formed steel structural designs have been used in floor and roof joists in the building construction trade for some time. However prior art cold-formed steel joists have found limited application due to the high costs of construction assembly, and are not cost effective for span lengths much above 24 feet usage is restricted to single and multi-family housing, and to commercial low rise structures.

Provided that light gauge steel is used, cost effective mass manufacture of cold-formed steel joists is practical because highly automated cold forming operations such as roll-forming are commercially available. Joists in the prior art are produced by cold-forming a single piece of sheet metal into a joist comprising a top chord, a web and a bottom chord forming a continuous single structure, and are predominately used in bottom chord bearing conditions. These joists are generally eccentric in that the load forces do not pass through the centre of gravity of the joist. The most common example from prior art is the C-shaped joist which has a cross sectional profile like the letter C. Other examples of cold rolled constructions are shown in U.S. Pat. Publication Nos. 2002/0020138 A1 and 2003/0084637 A1.

Composite fire rated floor structures constructed using cold-formed joists are commercially available. Examples are Hambro D510 and Speed Floor both of which have end attachments that are welded, bolted or screwed onto a single strip cold-formed section to provide a top chord bearing joist. However these provide only limited load capacity due to the nature of the localized connection of the end attachments to the cold-formed joist member. Further, they are costly to produce. Cold-formed joist manufacturers provide holes longitudinally along the central web section that are sized to receive utilities for follow-up trades. Since cold-formed joist material can be pre-finished (i.e. the coils of steel can be galvanized or painted) the manufacturing process is less harmful to the worker and environment than the open web coating process described above.

Although cold-formed joists possess superior surface finishes, and can be mass manufactured in a cost-effective manner because there is very little dependency on manpower involved relative to the open web joist technology, current state of the art cold-formed joist technology does not fully exploit the inherent strength to mass ratio of steel, nor does it optimize material usage throughout the length of the joist. The same thickness of steel is used in both of the chords and the web, this thickness being constant along the length of the joist. Eccentric designs have a tendency to be unstable under load due to a mechanical moment about the longitudinal axis. Consequently substantial bracing is required between joists to counteract this effect.

These properties compare unfavourably with the open web steel joist where the chords and the web may be of different thickness and the web member thickness may be varied over the span length in response to loading requirements.

Accordingly, a joist and method of producing said joist that can utilize the beneficial attributes while avoiding the drawbacks from each of the open web joist technology and cold-formed joist technology is desirable. Further, it is desirable to manufacture the joist using automated cold-forming methods as opposed to the labour intensive welding and handling methods employed in open web steel joist construction. It is also desirable to have cost effective fire rated composite floors and roofs based on cold-formed steel joists integrally attached to a concrete slab.

Also both open web and cold-formed steel joist floor and roof structures normally require bridging systems, comprising steel members spanning the gap between joists in a floor or roof assembly, to stabilize the assembly from any lateral movement or rotational movement about the longitudinal direction in response to applied loading. It is common practice to weld bridging in place between open web joists, while cold-formed joist systems have bridging structures that commonly use screws or welding for fastening. Consequently a cost effective means to provide bridging between joists is highly desirable.

SUMMARY OF THE INVENTION

It is an aspect of this invention to provide an upper chord bearing joist comprising an upper elongate chord member being cold-formed from a unitary piece of sheet steel, the upper chord member having a flange portion and a web receiving portion orthogonal thereto and the web receiving portion having two web receiving tabs and a pair of inner flange portions, each inner flange portion extending outward perpendicularly from one of the web receiving tabs; a lower elongate chord member, wherein the upper chord member extends outwardly of the lower chord member at each end thereof; and a generally planar steel web attached to the web receiving portion of the upper chord member between the two web receiving tabs and attached to the lower chord member. Without any limitations to the invention, such joist may be concentric or substantially concentric to provide improved stability.

It is another aspect of this invention to provide a supporting system for use between opposite walls that comprises a plurality of upper chord bearing joists, wherein each joist has upper and lower elongate chord members, each chord member being cold-formed from a unitary piece of sheet steel, the chord member having a flange portion and a web receiving portion orthogonal thereto and the web receiving portion having two web receiving tabs; and a generally planar steel web attached to the web receiving portion of the upper and lower chord members between the two web receiving tabs of each chord member; and wherein the joists are supported by and spanning a separation between opposing walls. Without any limitation to this invention, such a support system may form part of a composite floor system.

It is a further aspect of this invention to provide a composite floor system comprising a plurality of upper chord bearing joists, the joists including a concrete engaging portion extending upwardly therefrom and the concrete engaging portion having two thicknesses of steel; a deck resting on the upper chord member; and a concrete slab disposed on the upper chord of the plurality of joist and the deck with the concrete engaging portion of the upper chord embedded in the concrete slab to define the composite floor.

Another aspect of this invention is to provide bridging means comprising bridging members and receiving holes in the upper chord bearing joists such that said members may be snap fastened to the joists without the use of tools.

Another aspect of this invention resides in a method of producing an upper chord bearing joist comprising the steps of; cold-forming an upper chord member from sheet steel, the upper chord member having a flange portion and a web receiving portion orthogonal thereto and the web receiving portion having two tabs; forming at least one web member from sheet metal; and fastening the web between the two tabs of the web receiving portion of the chords with mechanical fasteners.

It is a further aspect of this invention to provide an upper chord bearing joist comprising an upper elongate chord member being cold-formed from a unitary piece of sheet steel, the chord member having a flange portion and a web receiving portion orthogonal thereto, the web receiving portion having two web receiving tabs; a lower elongate chord member, and wherein the upper chord member extends outwardly of the lower chord member at each end thereof; and a generally planar steel web attached to the web receiving portion of the upper chord member between the two web receiving tabs and attached to the lower chord member, and the web having a plurality of web members attached together.

These and other objects and features of the invention shall now be described in relation to the following drawings:

DETAILED DESCRIPTION OF THE INVENTION

In the description that follows, like parts are marked throughout the specification and the drawings with the same respective reference numbers. The drawings are not necessarily to scale and in some instances proportions may have been exaggerated in order to more clearly depict certain features of the invention.

Figures 1, 2:
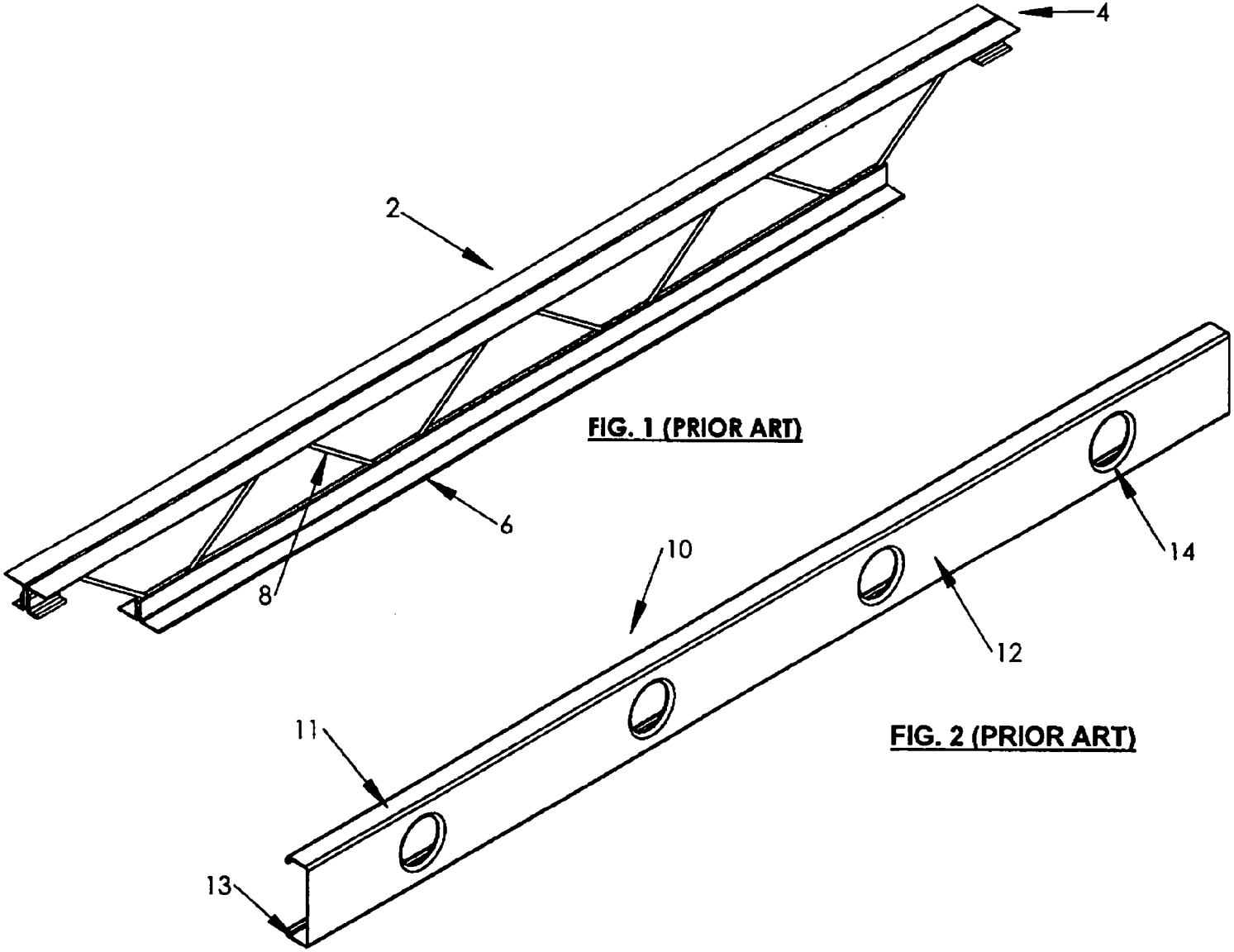
FIG. 1 (PRIOR ART)
FIG. 2 (PRIOR ART)
FIG. 1 illustrates a prior art open web steel joist (OWSJ)
FIG. 2 illustrates a prior art cold-formed C-shaped joist.

FIG. 1 illustrates a prior art open web joist construction 2 consisting of an upper chord assembly 4 spaced from a lower chord assembly 6. The chords are joined together by a zigzag web 8 which is generally connected to the upper and lower chord assemblies 4, 6 by a number of means including welding or the like.

FIG. 2 illustrates a prior art cold formed joist construction 10 roll-formed from a single strip of light gauge steel, having a web portion 12 having a plurality of holes 14 disposed therethrough for receiving utilities such as wire or the like, and having upper and lower chords 11 and 13 respectively.

Figures 3, 4:
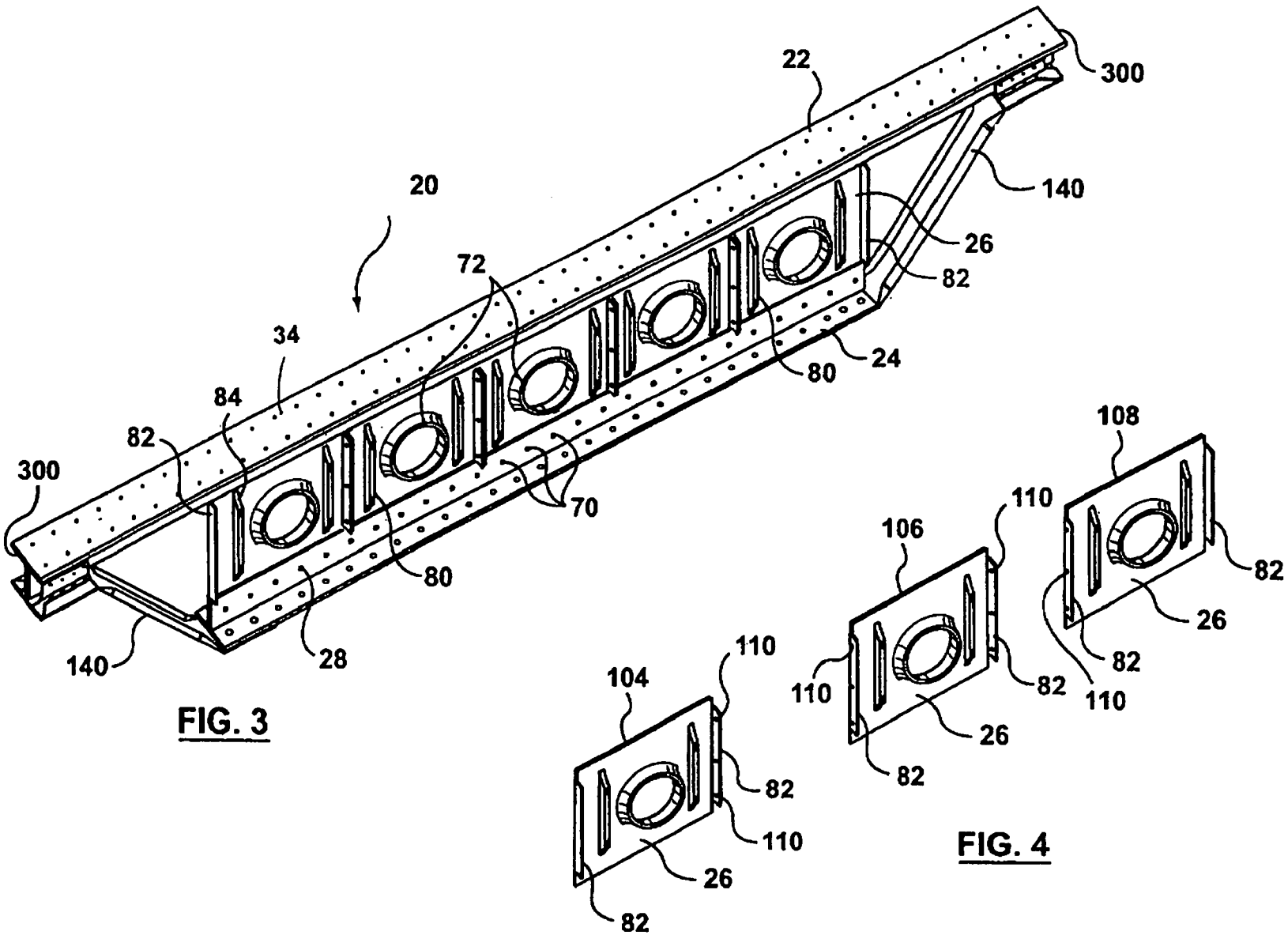
FIG. 3 illustrates one embodiment of the invention, a concentric top chord bearing segmented web steel joist.
FIG. 4 illustrates segments of a segmented web.
Figure 5:
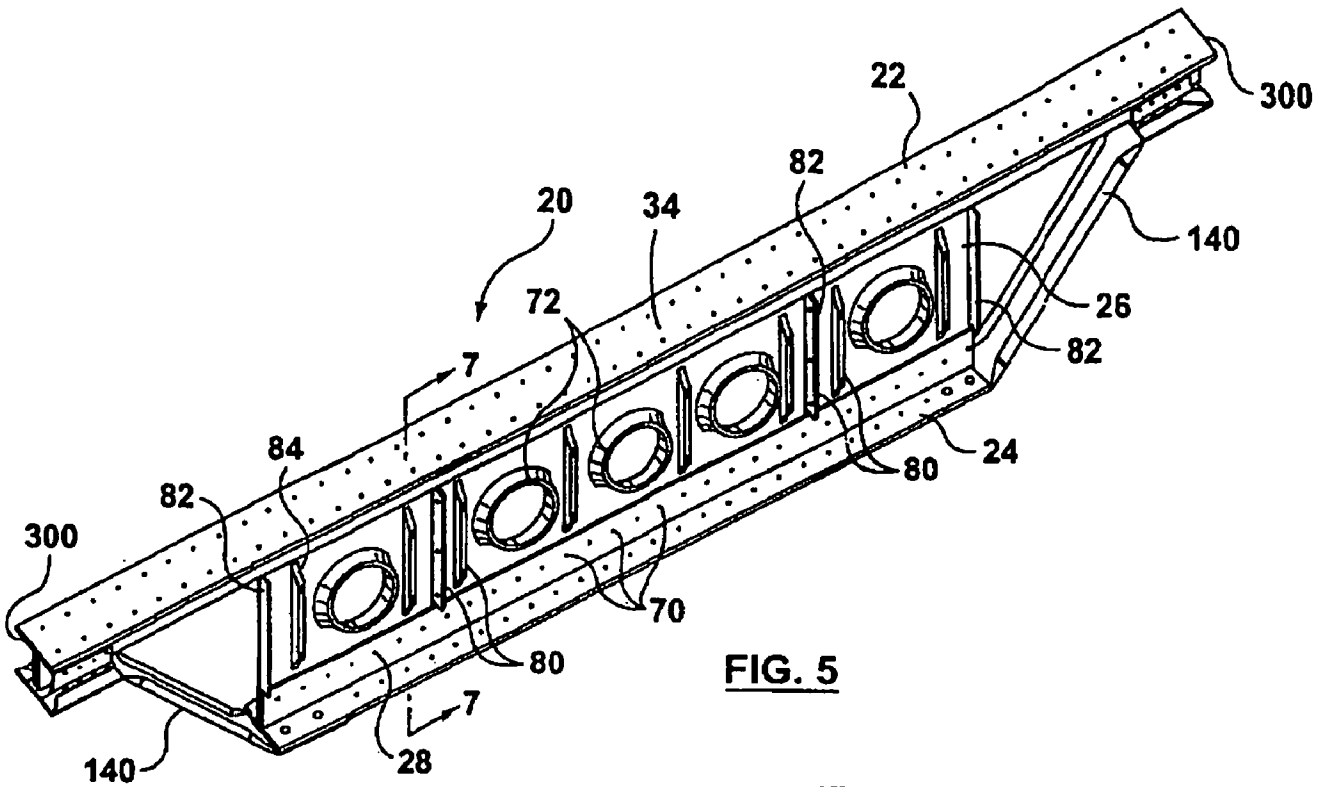
FIG. 5 is a perspective view of a second embodiment of the invention showing a concentric top chord bearing, cold-formed joist having three web segments.
Figure 6:
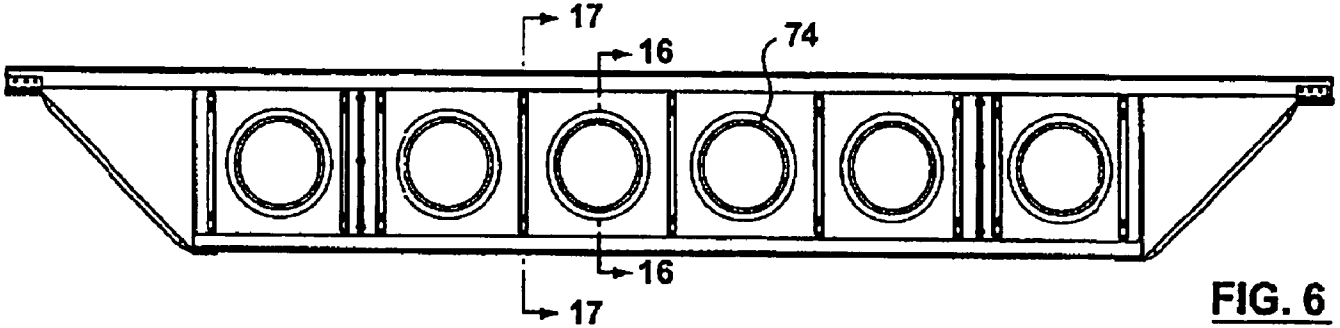
FIG. 6 is a side elevation view of FIG. 5.

FIGS. 3 and 5 illustrate two similar embodiments of the invention, namely top chord bearing concentric joists, which comprise an assembled joist 20 having a first or upper chord member 22 spaced from a second or lower chord member 24. A steel web member 26 is also disclosed. The web member 26 is fastened to the upper and lower chord members 22 and 24 by fastening means 28. The fastening means can comprise of a variety of fastening means such as bolts and nuts, screws, welding or spot clinches (not shown) or rivets 30 as shown in FIG. 7

The upper and lower chord members 22 and 24 are produced from single sheets of steel. The joist can be formed in a concentric fashion as shown in FIG. 7 where the upper and lower chord members 22 and 24 are substantially symmetrically disposed about web 26.

Figure 7:
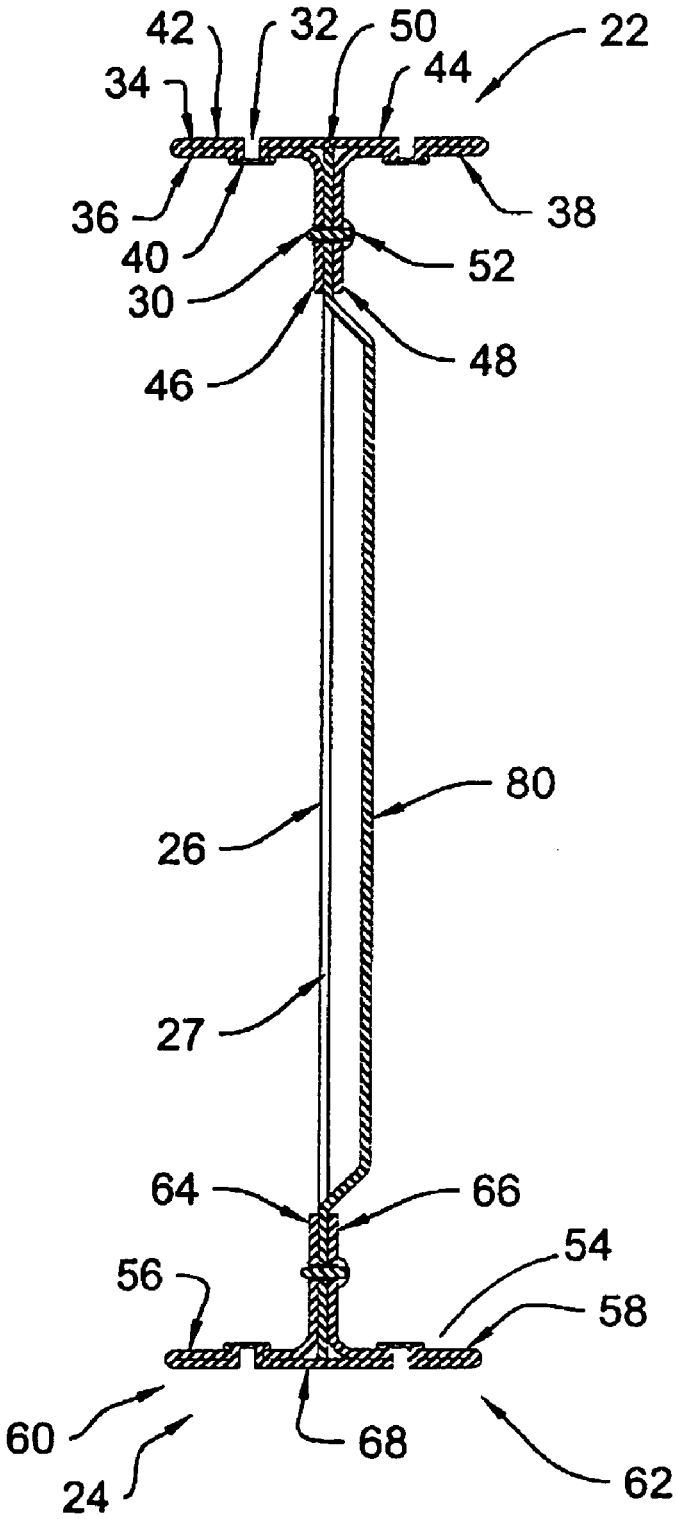
FIG. 7 is a cross sectional view along the line 7-7 of FIG. 5.

In these embodiments the upper chord member 22 is cold-formed to present a substantially flat upper load bearing surface 34 which is formed as shown in FIG. 7 to present lower load bearing wings or extensions 36 and 38. The upper load bearing surface 34 is in contact with the lower load bearing extensions 36 and 38 so as to produce a rigid and structurally solid member which may be fastened together by the spot clinch 32. The spot clinch process is conducted in the manner well known to those persons skilled in the art and generally consists of a mechanism which pushes material by a plunger (not shown) to present a mushroomed head 40 as shown so as to secure the members together.

The upper load bearing surface 34 and lower load bearing extensions 36 and 38 are disposed in this case symmetrically about the web 26, the direction of which defines the "Y" axis 27 as shown in FIG. 7. Accordingly, the upper load bearing surface 34 in concert with the lower load bearing extension 36 on one side of the axis 27 defines a horizontal extension 42 while the upper load bearing surface 34 to the right of the Y axis 27 in concert with the lower load bearing extension 38 defines a horizontal extension 44 disposed on the other side of the axis 27. The lower load bearing extensions 36 and 38 are cold-formed spaced apart web receiving tabs 46 and 48 as shown. The upper portion 50 of the web 26 may include a plurality of holes 52 which are adapted to receive the fastening means 28. FIG. 7 shows an example of a fastening means 28 comprising a rivet 30 that fastens the web 26 to the upper chord 22 at the tabs 46 and 48.

The spot clinches 32 in combination with the cold-formed chords connect the two folded portions 34 and 36 and 34 and 38 to reduce the width to thickness ratio of the section to avoid local buckling. The spot clinch 32 in combination with the cold work forming increases the yield strength of the steel part.

Figure 16:
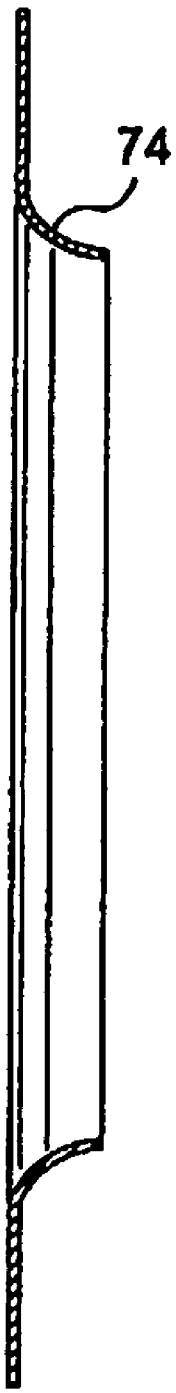
FIG. 16 is a cross sectional view of the web only through line 16-16 of FIG. 6.
Figure 17:
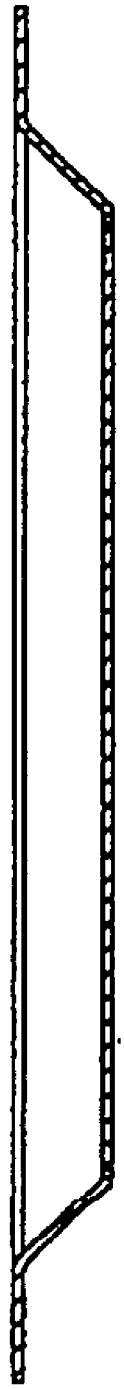
FIG. 17 is a cross sectional view of the web only along the line 17-17 of FIG. 6.
Figure 18:
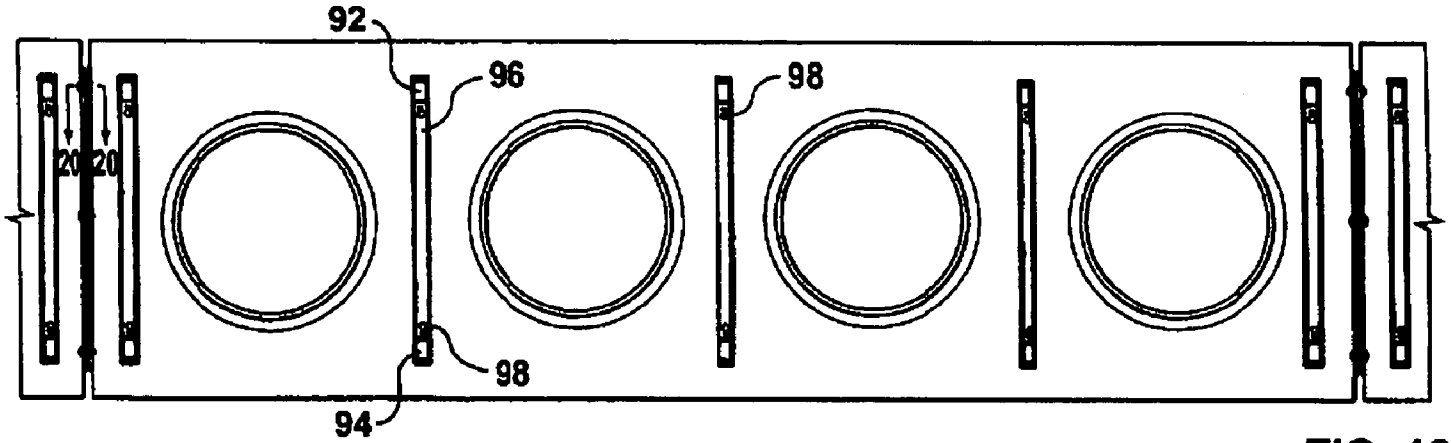
FIG. 18 is a partial side elevation view of a segmented web.
Figure 19:
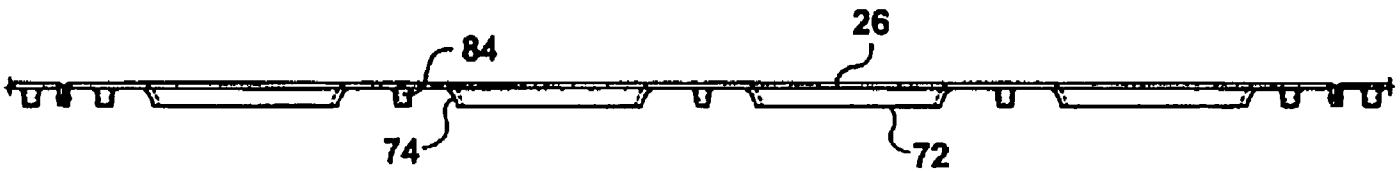
FIG. 19 is a top view of FIG. 18.
Figure 20:
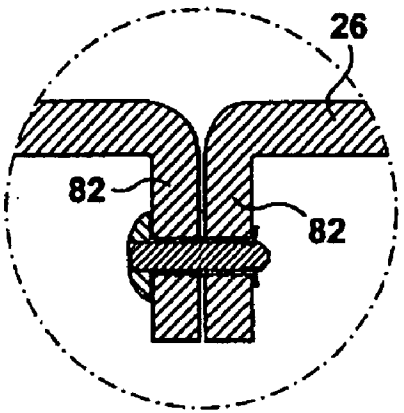
FIG. 20 is a top expanded view of region 20-20 In FIG. 18 showing a rivet joining two segments of a web.

As shown in FIG. 7 the lower chord 24 is similarly constructed by forming sheet metal to present a lower chord surface 54 bent so as to present lower chord extensions 56 and 58 symmetrically disposed about axis 27. The lower chord 54 with the lower chord extensions 56 and 58 define lower chord horizontal extensions 60 and 62 in this case symmetrically disposed about the web 26. The lower chord extensions 56 and 58 present two spaced apart web receiving tabs 64 and 66 which are adapted to receive the lower portion 68 of the web 26. The lower chord is also fastened to the lower part of the web 26 by rivets or other means The web 26 can include a plurality of utility holes 72 which provide an access for utilities such as electrical wires, air ducts or the like. The holes 72 as shown are circular although any configuration can be produced including square holes or the like. Furthermore, the holes 72 can include a cold-formed lip 74 as shown in FIG. 16. The holes 72 lighten the total weight of the joist 20 while the cold-formed lip 74 adds rigidity to the web structure 26 particularly in the direction of the "Y" axis 27.

The web 26 may also include a plurality of stiffening means 80 to stiffen of the web member 26.

Figure 21:
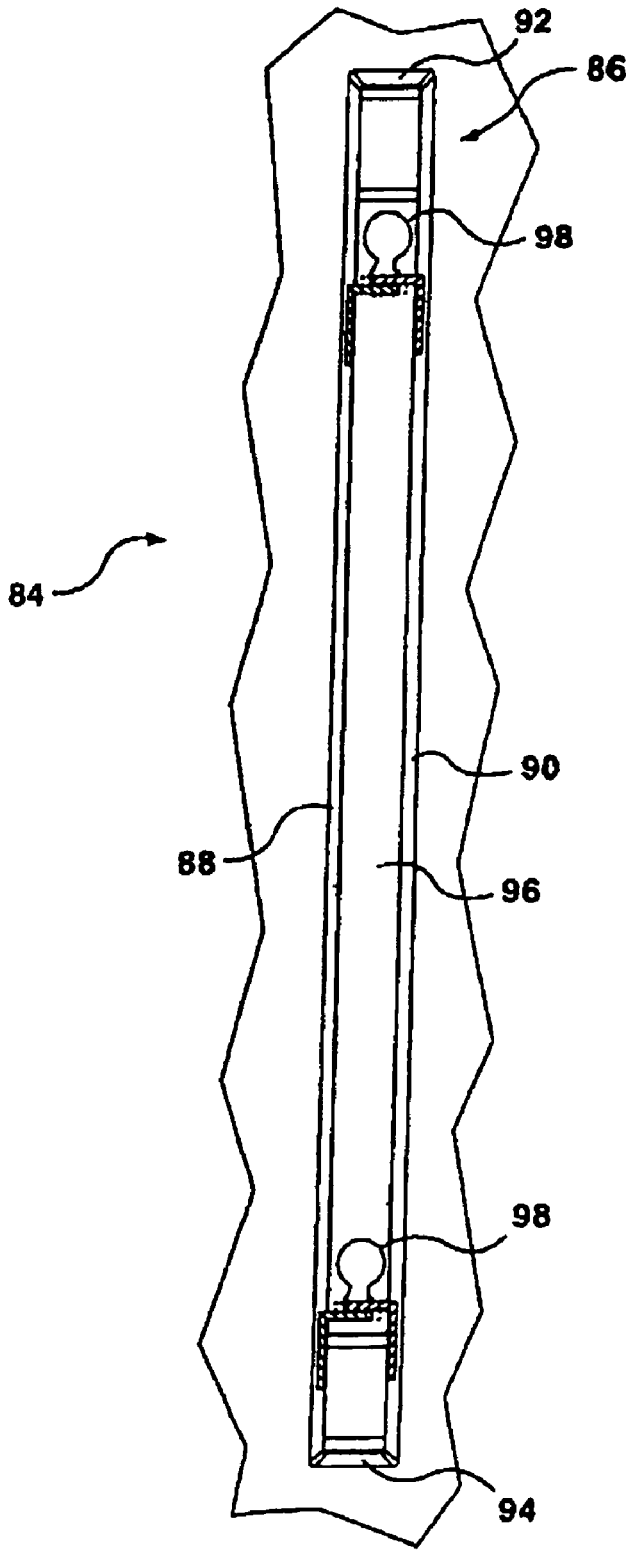
FIG. 21 is a partial side elevation view of the reinforcing member 84 shown in FIG. 5.

The stiffening means 80 comprises a first stiffening means 82 and a second stiffening means 84. The first stiffening means 82 generally consists of the ends of the web segment 26 being bent to form a stiffening tab 82 which is disposed at approximately a 90 degree angle from the web 26. The second stiffening means 84 may consist of a hollow embossed rib structure 86 as illustrated in FIG. 21.

The hollow rib structure 86 can be produced by a variety of means and in one example is produced by a punch (not shown) which pushes the web material 26 to present the stiffening structure 84. The stiffening structure has two spaced side walls 88 and 90 as well as upper and lower walls 92 and 94 and stiffening front wall 96. The stiffening front wall 96 has stiffening holes 98 which are adapted to receive bridging members 170 and 171 in a manner to be more fully particularized herein.

Furthermore, the web 26 can comprise a plurality of web segments 104, 106 and 108, as shown in FIG. 4, in which, as an example, three segments are shown. Each of the web segments 104, 106 and 108 are adapted to be fastened to one another. In particular, the web segments 104, 106, 108 include a first stiffening means 82 which comprise sheet metal flaps which are bent at substantially 90 degrees from the web material 26. The first stiffening flaps 82 may include a plurality of holes 110 which are adapted to receive fasteners such as rivets, nuts and bolts, or may receive spot clinches to secure the plurality of web segments 104, 106, and 108 together to form a web 26. The web segments 104, 106, and 108 also include second stiffening means 84, shown in FIG. 3.

The web segments can either all have the same thickness or have different selected thickness. For example the web segments can be thicker at the ends of the joist than segments in the middle of the joist since the shear stresses under load are greater at the ends than in the middle.

The joist shown in FIGS. 3 and 5 include angled end support members 140 that secure the ends of the lower chord 24 and upper chord 22.

Figure 8:
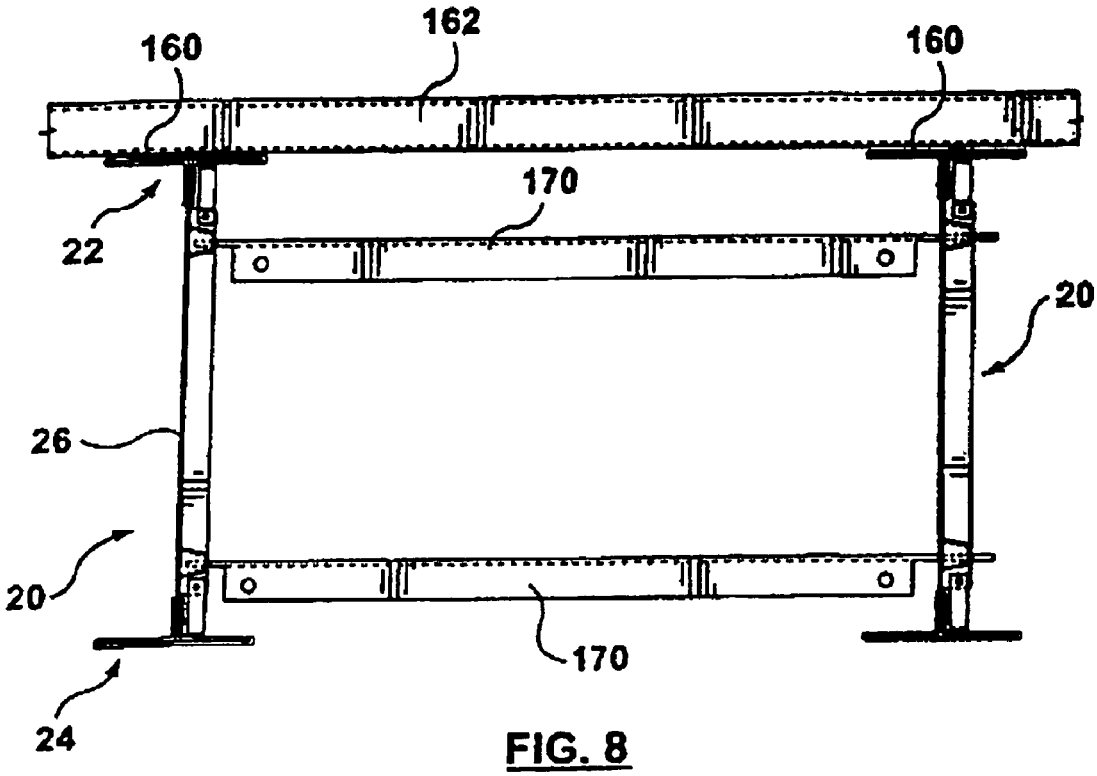
FIG. 8 illustrates a side-view of a plurality of joists having bridging members.
Figure 9:
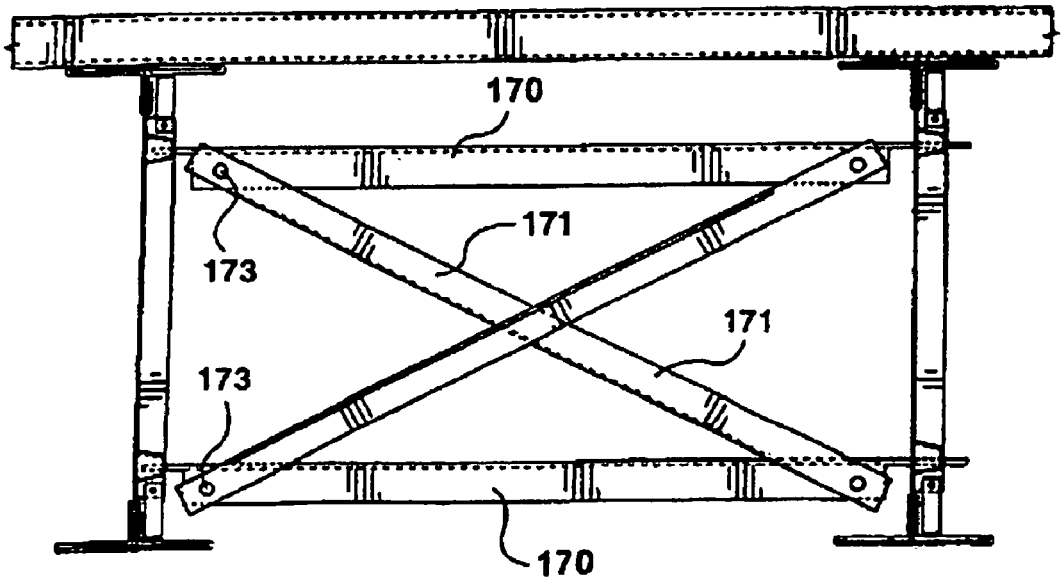
FIG. 9 is a side elevation view of a plurality of joists having both horizontal bridging and crossed bridging members.
Figure 10:
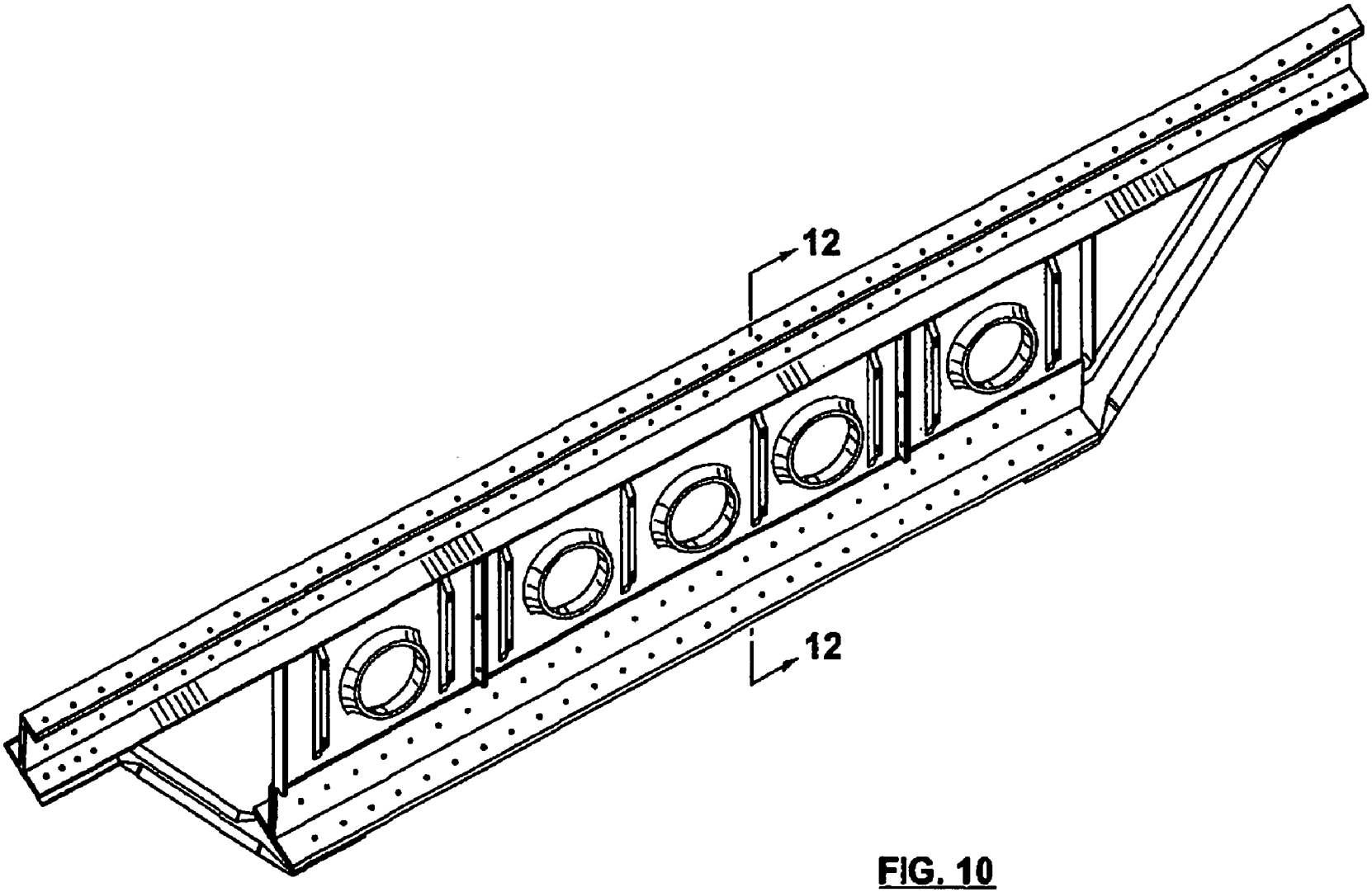
FIG. 10 is a perspective view of a concentric top chord bearing segmented web cold-formed joist to be used in a composite floor or roof structure.
Figure 11:
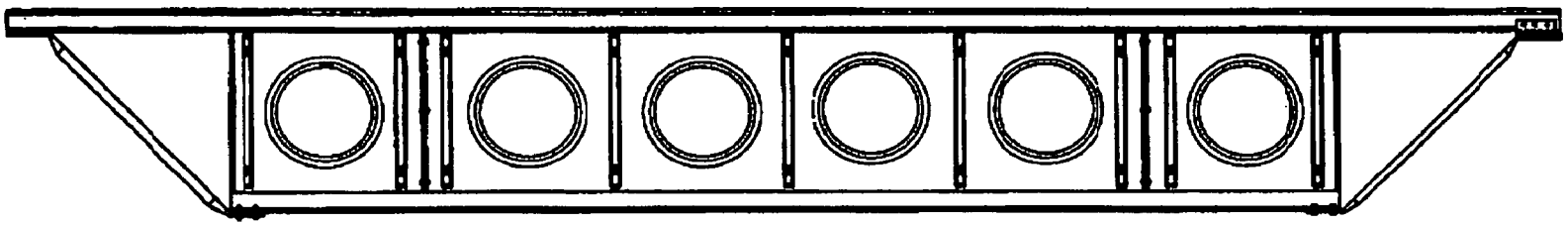
FIG. 11 is a side elevation view of FIG. 10.

A structural assembly comprising a plurality of joists 20 partially shown at FIGS. 8 and 9 can define a supporting surface 160 to support a platform 162 such as a roof or floor. Each of the joists 20 as shown in cross section comprises spaced apart cold-formed steel upper and lower chord members 22 and 24 and a steel web 26 intermediate between upper and lower chord members 22 and 24. Fasteners 28 are utilised to fasten the web to the upper and lower chords and the top surface of upper chords 22 define the supporting surface 160.

Figure 22:
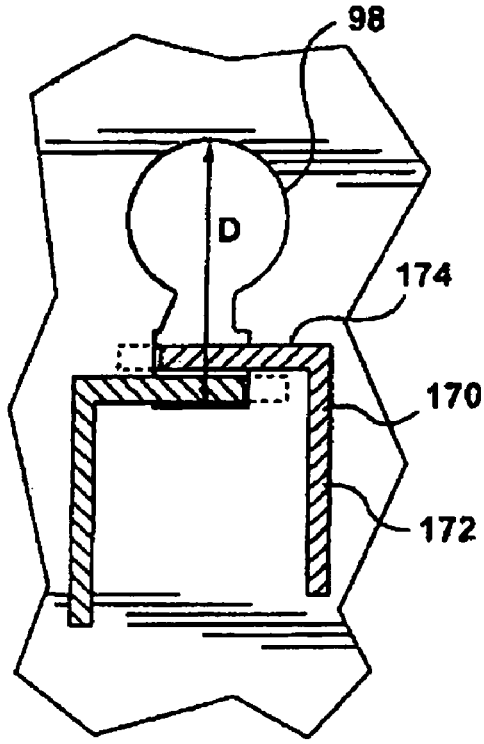
FIG. 22 is a partial view of FIG. 21.
Figure 23:
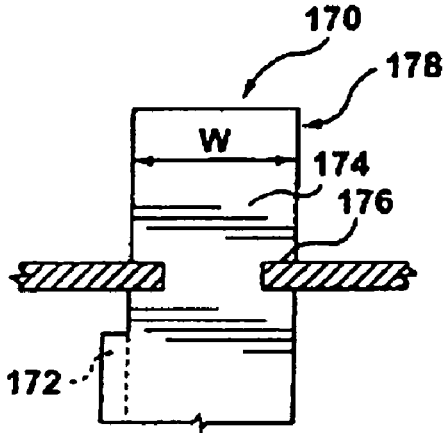
FIG. 23 is a partial top plan view of the reinforcing member. Clarify this drwg

A plurality of bridging members 170 and 171 may be used to connect adjacent joists 20 together as shown so as to stiffen the said joist assembly. Parallel bridges 170 may be used as shown in FIG. 8, or may be accompanied by crisscrossed bridges 171 that are appropriately fastened to the horizontal bridges 170 at 173 as shown in FIG. 9. The fastening of the bridges 170 to the joists 20 through holes in the embossed features 84 is shown in greater detail in FIGS. 21, 22 and 23, effectively creating a snap in place connection without the use of tools.

The bridge members such as 170 may be formed in an L-shaped cross section from sheet steel to produce a first surface 172 and a second surface 174. The second surface 174 is slotted at 176 as shown and the width W of surface 174 is less than the depth D of the hole 98 to permit the end 178 of the bridging member 170 to be inserted into the hole 98 and then rotated so as to lock the edges of the slot 176 against the reinforcement face 96 adjacent the hole 98. Criss-crossed bridging members 171 may then be added and fastened as shown in FIG. 9.

Figure 12:
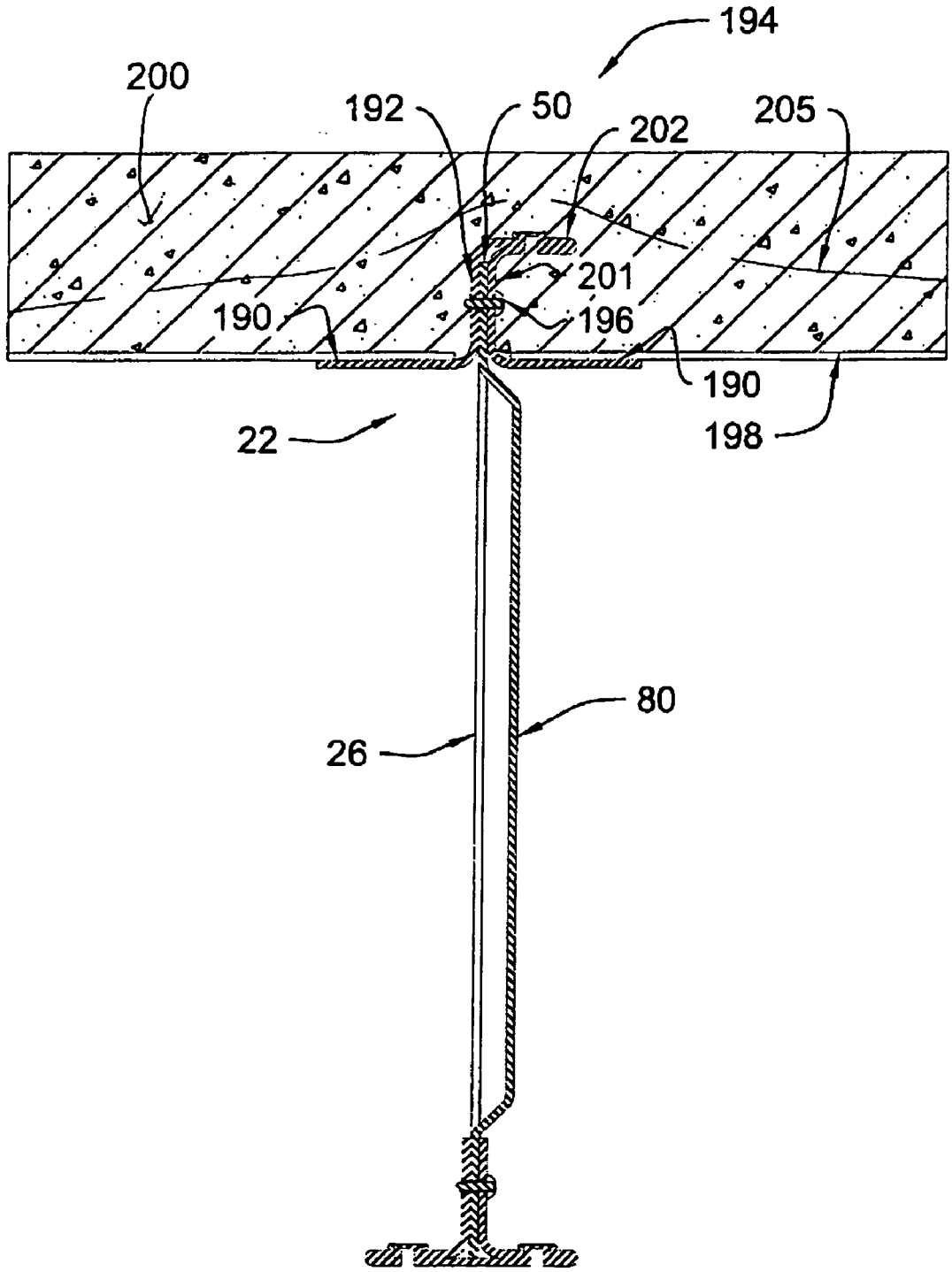
FIG. 12 is a cross sectional view along the lines 12-12 of FIG. 10 and also showing a concrete slab attached thereto.
Figure 13:
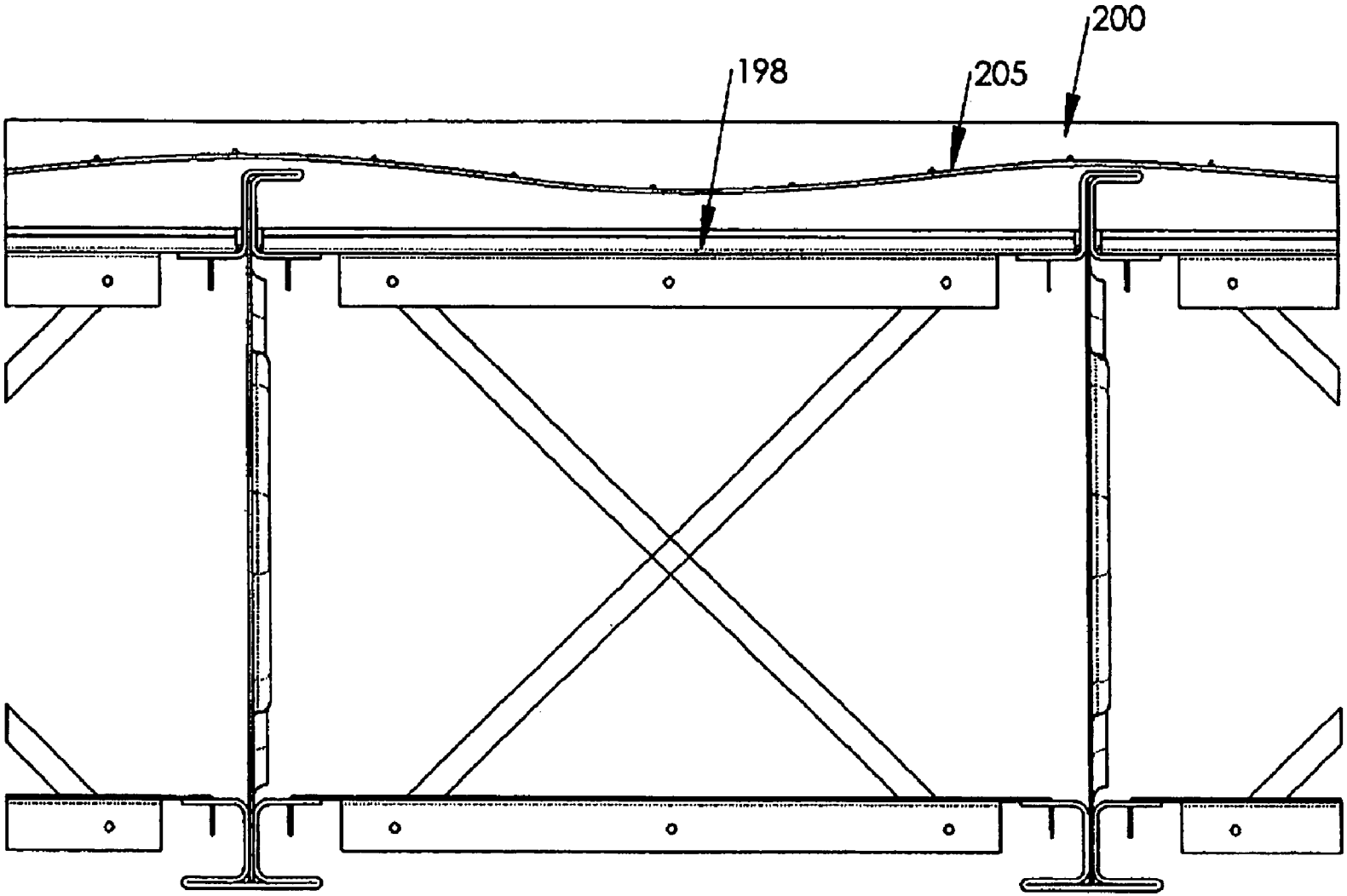
FIG. 13 is a side elevation view of a composite floor system having a plurality of joists.

FIGS. 12 and 13 illustrate another embodiment of the invention defining a composite floor or roof structure. In particular, the upper chord 22 can be cold-formed so as to present horizontal extensions 190 symmetrically disposed about the central web 26 and presents spaced apart vertical extensions 192 and 201 adapted to receive the top portion 50 of the web 26 to define a vertical extension 194. A rivet 196 may be utilized to fasten the upper chord 22 to the web 26 as shown.

A steel deck 198 is adapted to rest on the top surface of the horizontal upper chord extensions 190 as shown in FIGS. 12 and 13. A wire mesh 205 is added. Thereafter concrete 206 can be poured onto the deck 198 so as to produce a floor or ceiling. Since the vertical extensions 194 are embedded into and bonded with the concrete 200, a very solid composite floor system is produced. The vertical extension 194 can also include a generally horizontal concrete engaging extension 202 that runs along the length of the chord 22. Since the horizontal concrete engaging extension 202 runs along the length of the chord 22, the possibility of snagging a worker's foot or clothing is minimized thereby adding to the safety feature of the joist prior to pouring of the concrete 206 over the deck 198.

Figure 24:
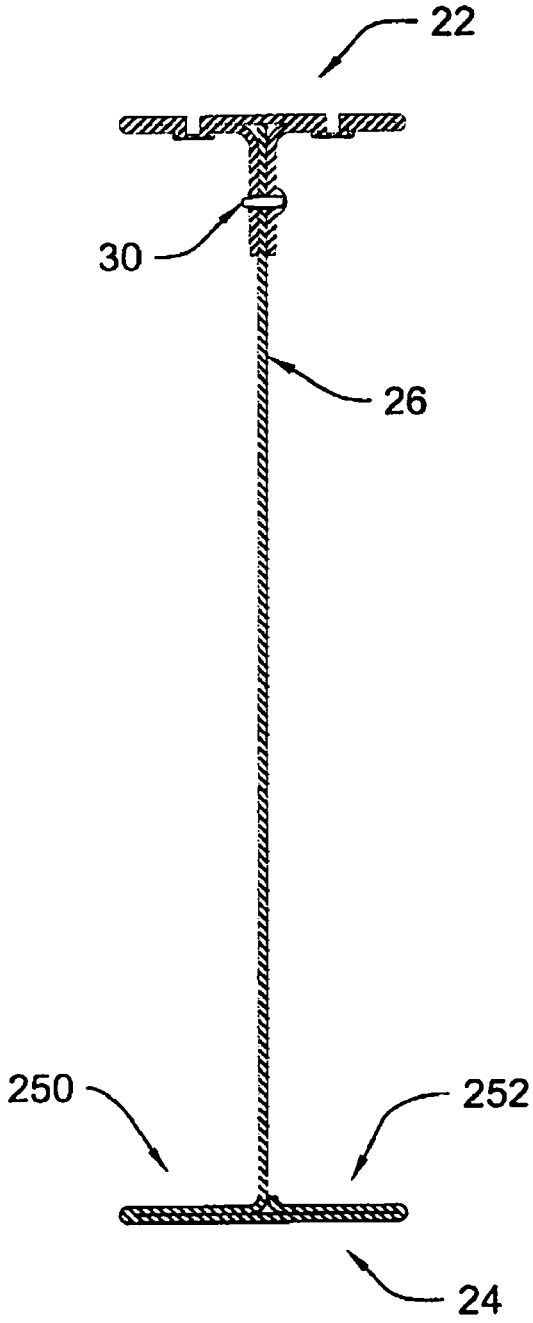
FIG. 24 is a cross-sectional view of further embodiments of the joist wherein the web and the bottom chord are cold-formed from the same sheet of steel.

The shear bond between the extensions 194 and 202 and the concrete may be increased by using rivets spot clinches or the like to increase the surface area of contact between the concrete and the top chord. Despite the asymmetry provided by the horizontal engaging extension 202, this embodiment of the joist is substantially concentric since the extensions 194 and 202 are bonded to the concrete and the steel-concrete composite effectively distributes the applied load to each joist through its centre of gravity FIG. 24 illustrates another embodiment of the invention which includes an upper cold-formed steel chord 22 fastened to a steel web 26 by fasteners 30. In the embodiment shown, the bottom chord 24 is a cold-formed extension of the web formed so as to present a horizontal extension 250 and 252 which may be of double thickness as shown and may be hole clinched (not shown) and may be disposed symmetrically or asymmetrically about the plane of the web.

Figure 25:
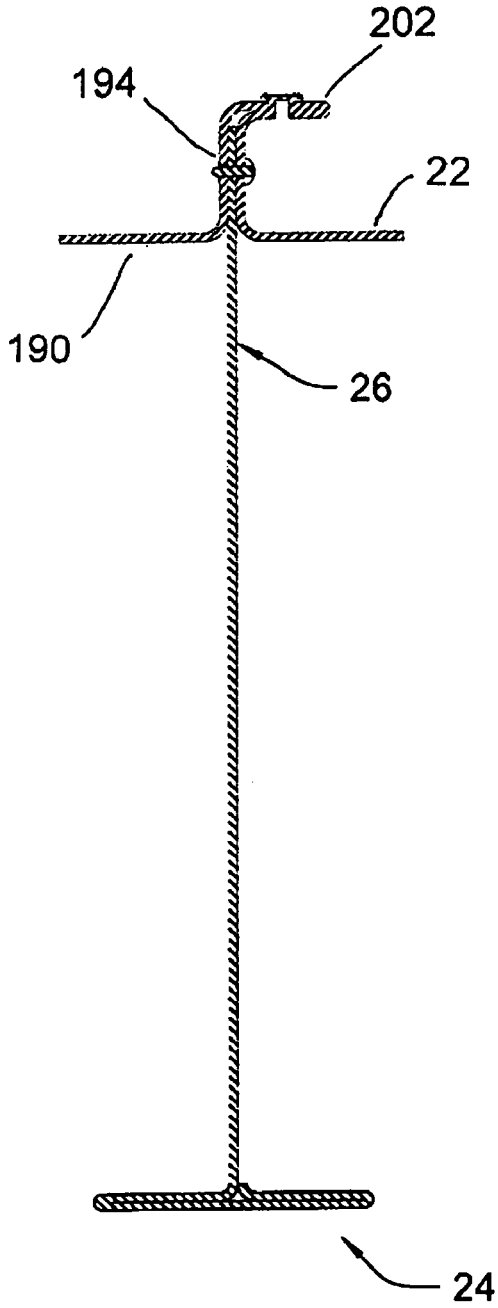
FIG. 25 is a cross-sectional view of further embodiments of the joist wherein the web and the bottom chord are cold-formed from the same sheet of steel.

FIG. 25 illustrates another embodiment of the invention, similar that shown in FIG. 24 where the upper chord 22 has a single layer of sheet metal which is bent to produce the horizontal extensions 190 spaced apart to accommodate the end 50 of web 26 so as to define an upper vertical extension 194 having a horizontal concrete engaging extension 202. The horizontal concrete engaging extension 202 can include a plurality of hole clinches to further strengthen the bond between the concrete and the upper chord 22 and thereby increase the shear strength of the composite. Clearly different further embodiments are possible wherein the bottom chord, being a cold-formed extension of the web, may have different forms being symmetric or asymmetric about the web axis, and in parts being of different multiples of the web thickness.

Figure 31:
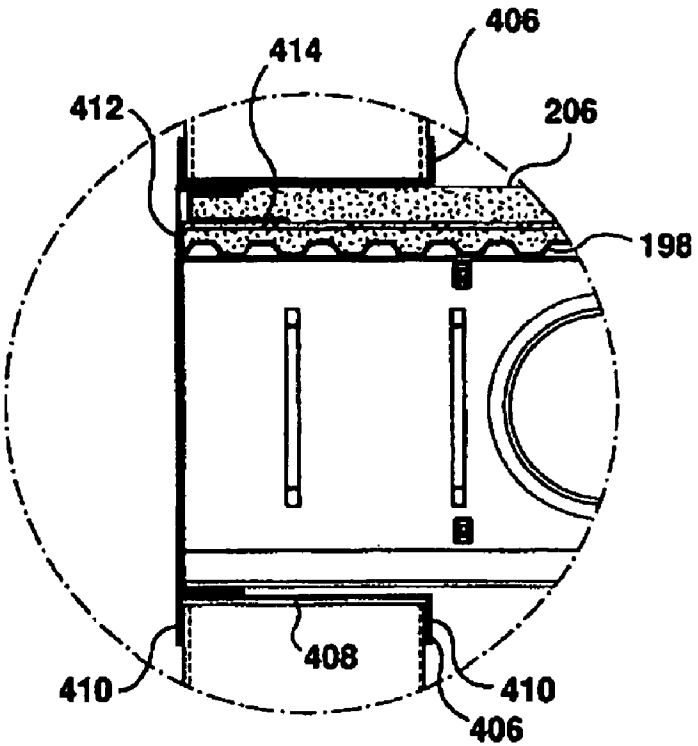
FIG. 31 is a partial enlarged view of FIG. 30.

In the following, methods to locate and affix the joist to the opposed supporting walls are described. The joist 20 can be supported along the bottom chord 24 as shown in FIGS. 30 and 31 illustrating a bottom chord bearing composite joist embodiment 20 supported by the bottom chord 24.

In particular the ends 400 of the joist are disposed within the lower stud wall 402 and upper stud wall 404 as shown. The lower stud wall 402 includes a stud wall track 406 which is generally a flat piece of sheet steel 408 bent at its ends so as to present a solid surface to the joist. The upper stud wall 404 includes a similar stud wall track 406. The stud walls 402 and 404 also includes a floor joist track 412 adjacent the end 400 of joist 20.

Figure 30:
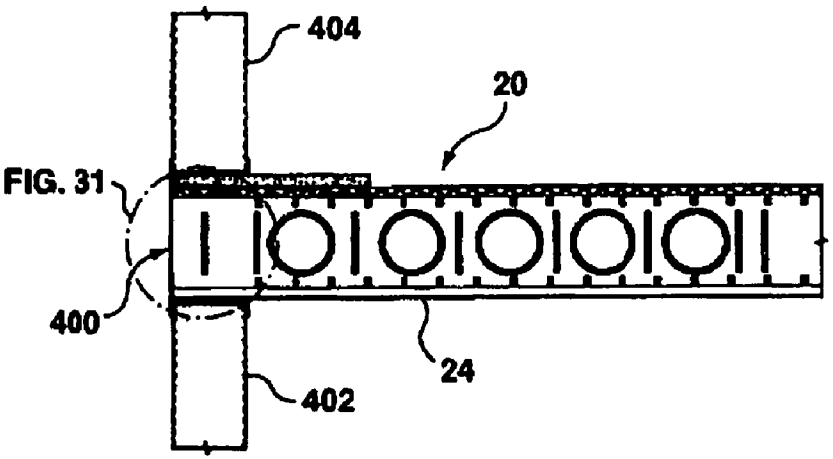
FIG. 30 is a side elevation view of an embodiment of one end of a bottom chord bearing composite cold-formed joist bonded to a concrete slab and integrated into a side wall.

The view of the joist 20 seen in FIG. 30 can have a number of configurations as described in the context of the composite joist including that shown in FIG. 12. The composite joist is constructed in the manner previously described. An erection clip 414 can be utilized so as to locate the joist 20 prior to pouring the concrete to produce the composite joist. In particular the erection clip 414 comprises a general J-shaped clip in cross-section which is secured to the bottom of the stud wall track 406 and extension 202. Once the concrete 200 is poured, the composite cold formed steel joist is supported by the bottom chord 24 at the ends 400 of the joist 20.

Figure 35:
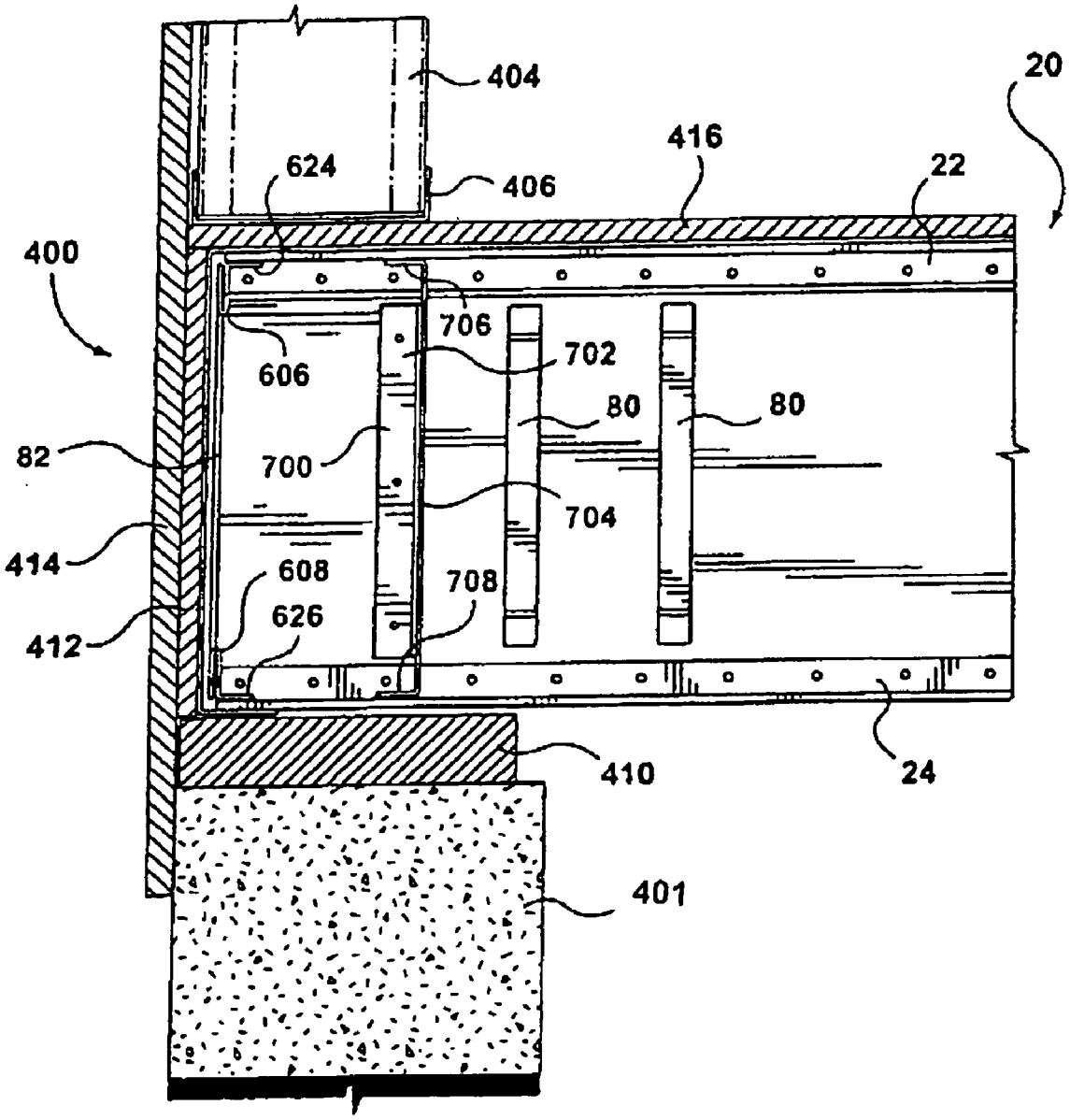
FIG. 35 is a side elevation view of one end of a bottom chord bearing cold-formed joist supported by a foundation wall and supporting a stud wall.
Figure 36B:
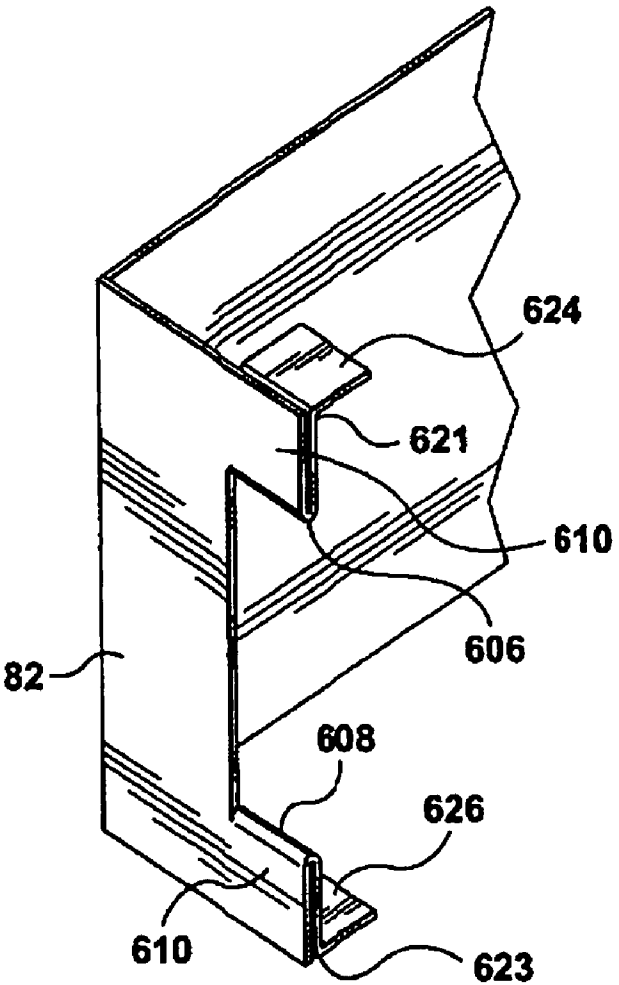
FIG. 36*b* is a perspective view of the reinforcing flap of FIG. 35.
Figure 36A:
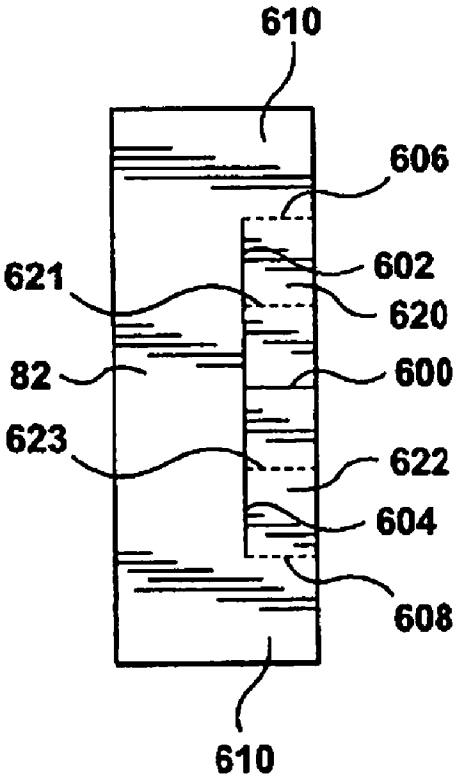
FIG. 36*a* is a top plan view of the reinforcing flap of FIG. 35.

FIG. 35, together with the enlargements depicted in FIGS. 36*a* and 36*b*, illustrates another bottom chord bearing embodiment of the invention supported by the foundation walls and supporting the stud walls in a residential home.

In particular the joist 20 rests on a foundation 401 having a bearing support 410. The end 400 of the joist 20 includes a reinforcing flap 82, which provides support against the compressive forces arising from loads applied through the stud wall 404, and is further particularized in FIG. 36*a* and 36*b*. In particular the flap 82 is cut along cut lines 600, 602 and 604 so as to present portions 620 and 622. In particular portions 620 and 622 are folded along fold lines 606 and 608. Thereafter portions 620 and 622 are further folded along fold lines 621 and 623 so as to present wing portions 624 and 626 which are adapted to contact respectively the lower surface of upper chord member 22 and upper surface of lower chord member 24 as best shown in FIG. 35. Fastening means may be utilized to fasten the reinforcing wings 624 and 626 to upper and lower chord members 22 and 24 so as to further rigidify and strengthen the joist 20.

Wooden or metal backing plates 412 are also utilized as shown in FIG. 35. Wooden pieces 414 may also be disposed as shown. The upper chord 22 provides a support surface for supporting plywood 416 or the like.

Further end reinforcing members 700 may be utilized which comprises an elongated section of sheet metal having web contacting portions 702 and rigidifying portions 704 extending generally perpendicular to the web contacting portions 702. The ends of the rigidifying portions 704 are bent at 706 and 708 and adapted to contact the upper chord 22 and lower chord 24 respectively. Furthermore fastening means may be utilized to fasten the rigidifying section 700 to web 26 and upper and lower chords 22 and 24.

Figure 38:
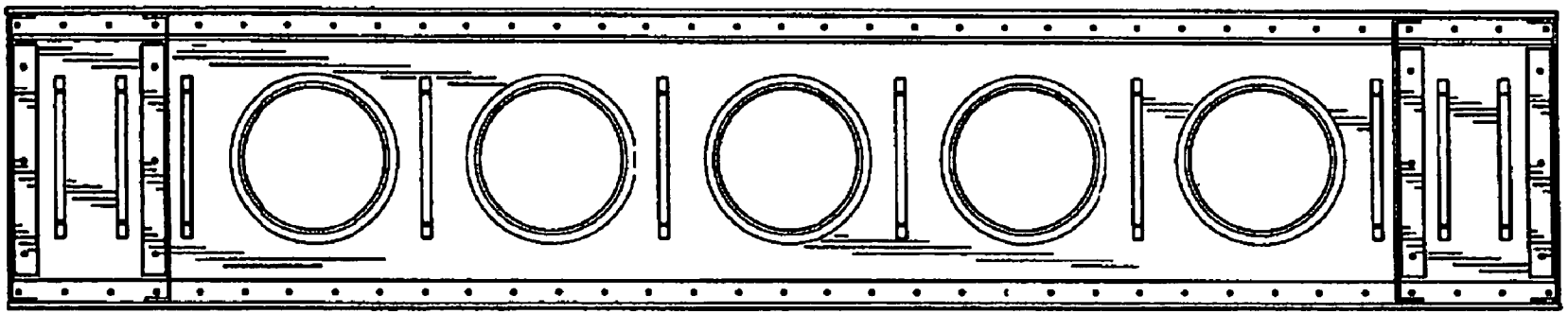
FIG. 38 is a bottom chord bearing embodiment of the Invention illustrating the reinforcing end flaps.
Figure 39:
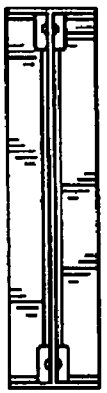
FIG. 39 is a side elevation view of FIG. 38.
Figure 37:
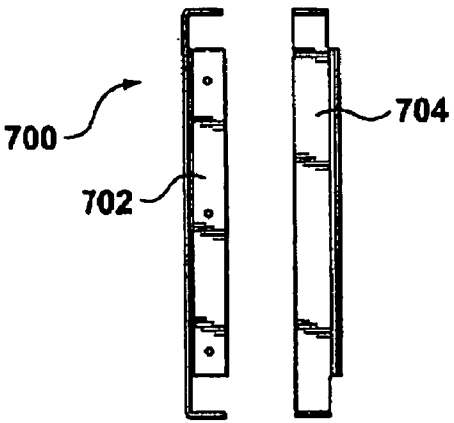
FIG. 37 shows top and plan views of a further reinforcing flap of FIG. 35.

Moreover FIG. 38 illustrates an embodiment of a bottom chord bearing cold-formed joist utilizing the reinforcing structure 700 shown in FIG. 37.

Figure 28:
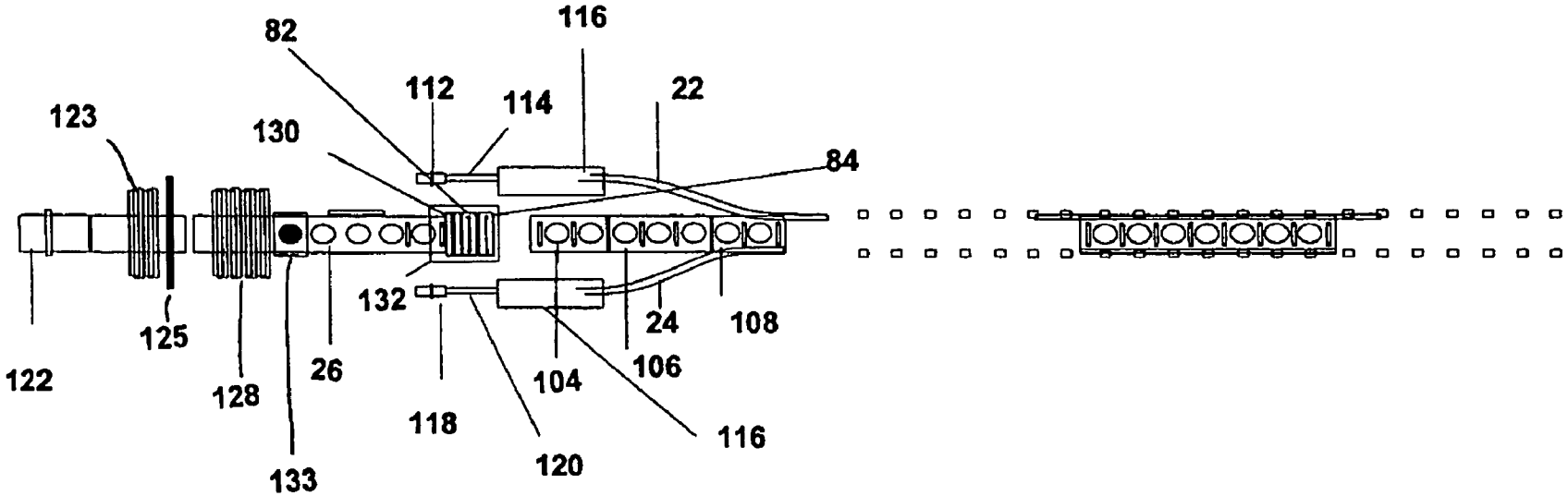
FIG. 28 is a schematic view of an automated assembly line for the manufacture of cold-formed joists.

FIG. 28 generally illustrates a method of producing the said embodiments of the cold-formed joist. The upper chord 22 can be produced by unrolling a coil of sheet steel 112 along path 114 to a roll forming machine 116 such as sold by Samco machinery located in Toronto, Canada. The roll forming machine 116 can include a station to flatten and cut a selected length of the upper chord member 22. Similarly, the lower chord member 24 can be produced by unrolling a coil of sheet steel 118 and flattening same along a path 120 to a roll forming machine 116 and then cutting to the desired length. Furthermore, the web 26 can also be produced by unwinding a coil of sheet steel 122 and flattening same at flattening station 123. A shear 125 can be used to shear the web member 26 to its desired length. Thereafter, the web 26 approaches stiffening section 128 so as to produce the first and second stiffening means 82 and 84 as described.

The shear 125 can be used to produce the plurality of segmented webs 104, 106 and 108. Each web segment 104, 106, 108 can have the left hand and right hand stiffening flaps 82 produced by stiffening station 130 and 132. An appropriate punch 133 is used to produce the second stiffening means 84 as described above in a drawing operation. As well, punch 133 is used to produce holes 72 and area embossments 184.

The sheet steel at stations 112, 118 and 122 can be galvanized or painted as desired prior to the forming process. Furthermore the roll forming machine 116 may include punches to punch the appropriate holes 52 in the upper and lower chord members 22 and 24 so as to accommodate the appropriate fastening means 28.

Alternatively the roll forming machine 116 can include apparatus to spot clinch 32 the members together.

Figures 14, 14A:
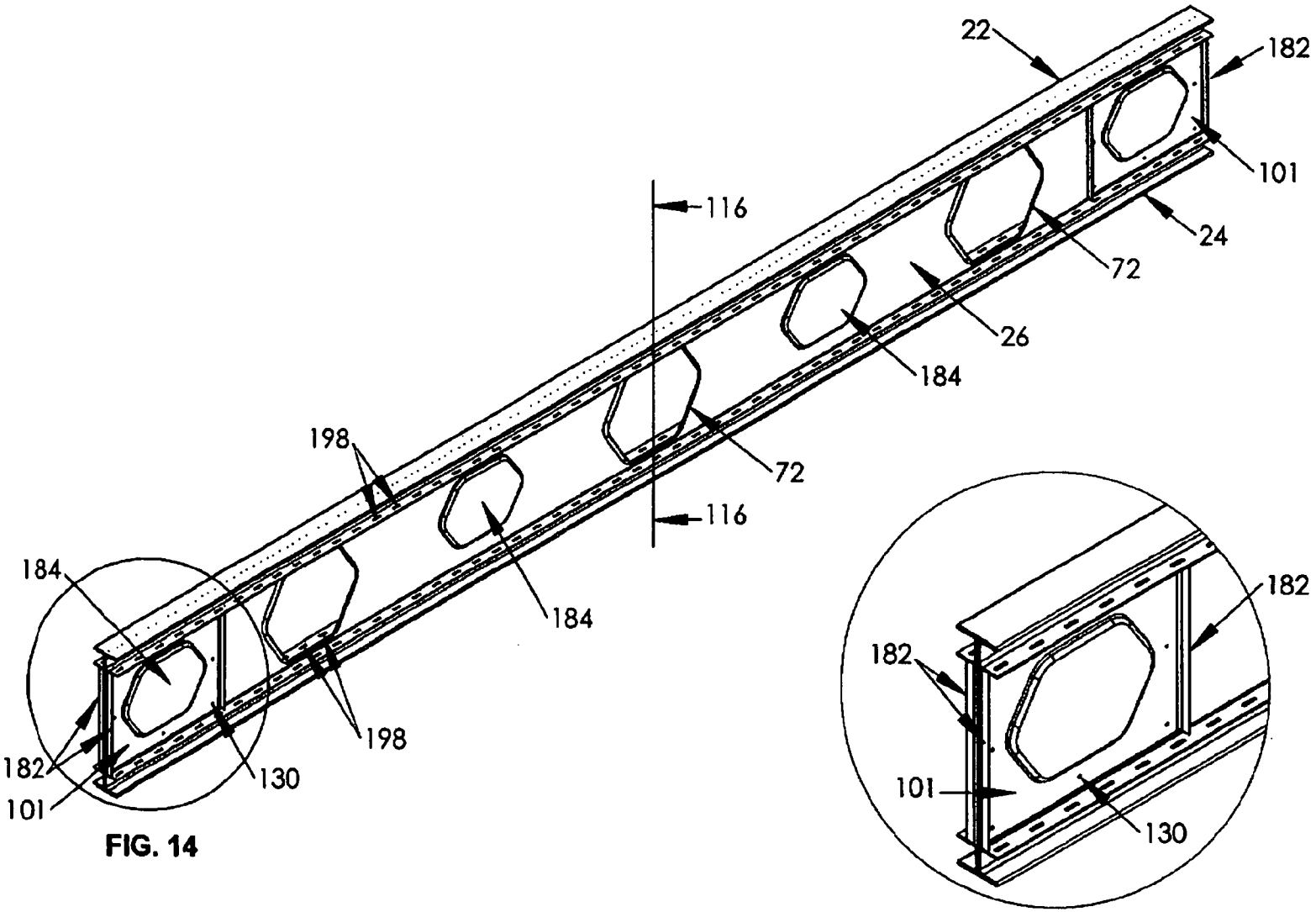
FIG. 14 and enlargement 14*a* are perspective views showing a bottom chord bearing version of another embodiment of the invention.
Figure 15:
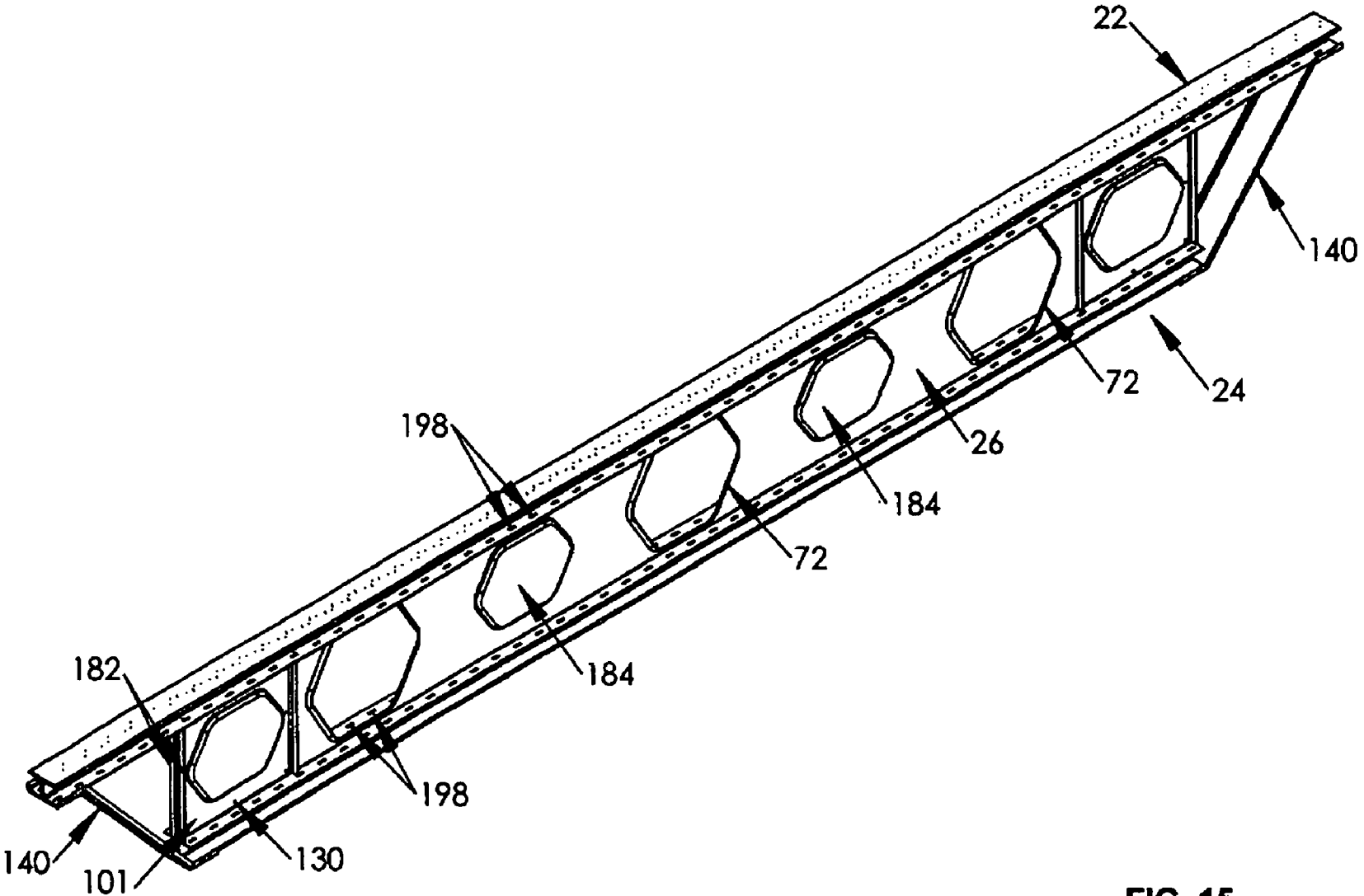
FIG. 15 is a perspective view showing a top chord bearing version of another embodiment of the invention.
Figures 26, 26A:
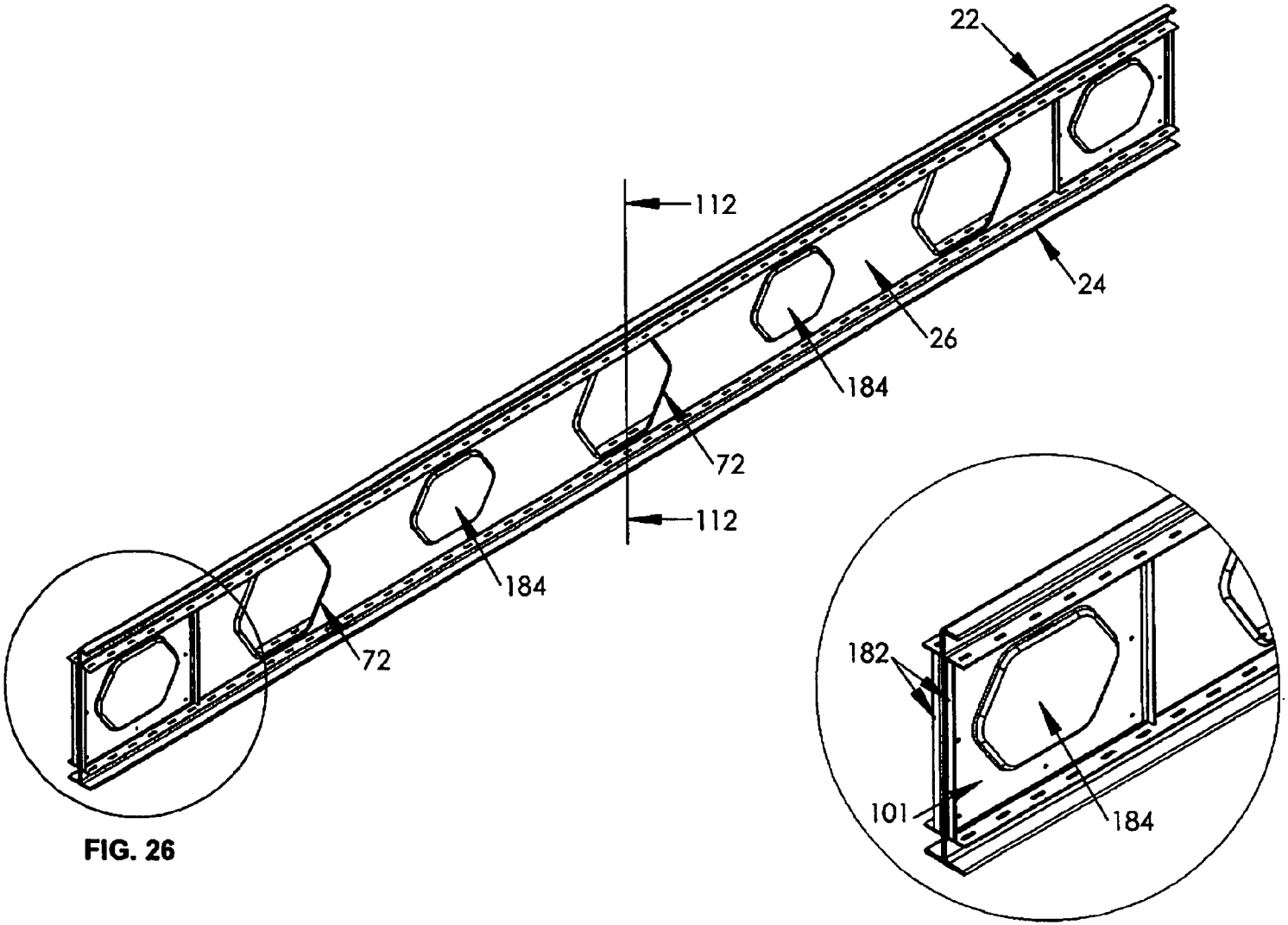
FIG. 26 and enlargement 26*a* are perspective views of a bottom chord bearing composite version of another embodiment of the invention.
Figure 27:
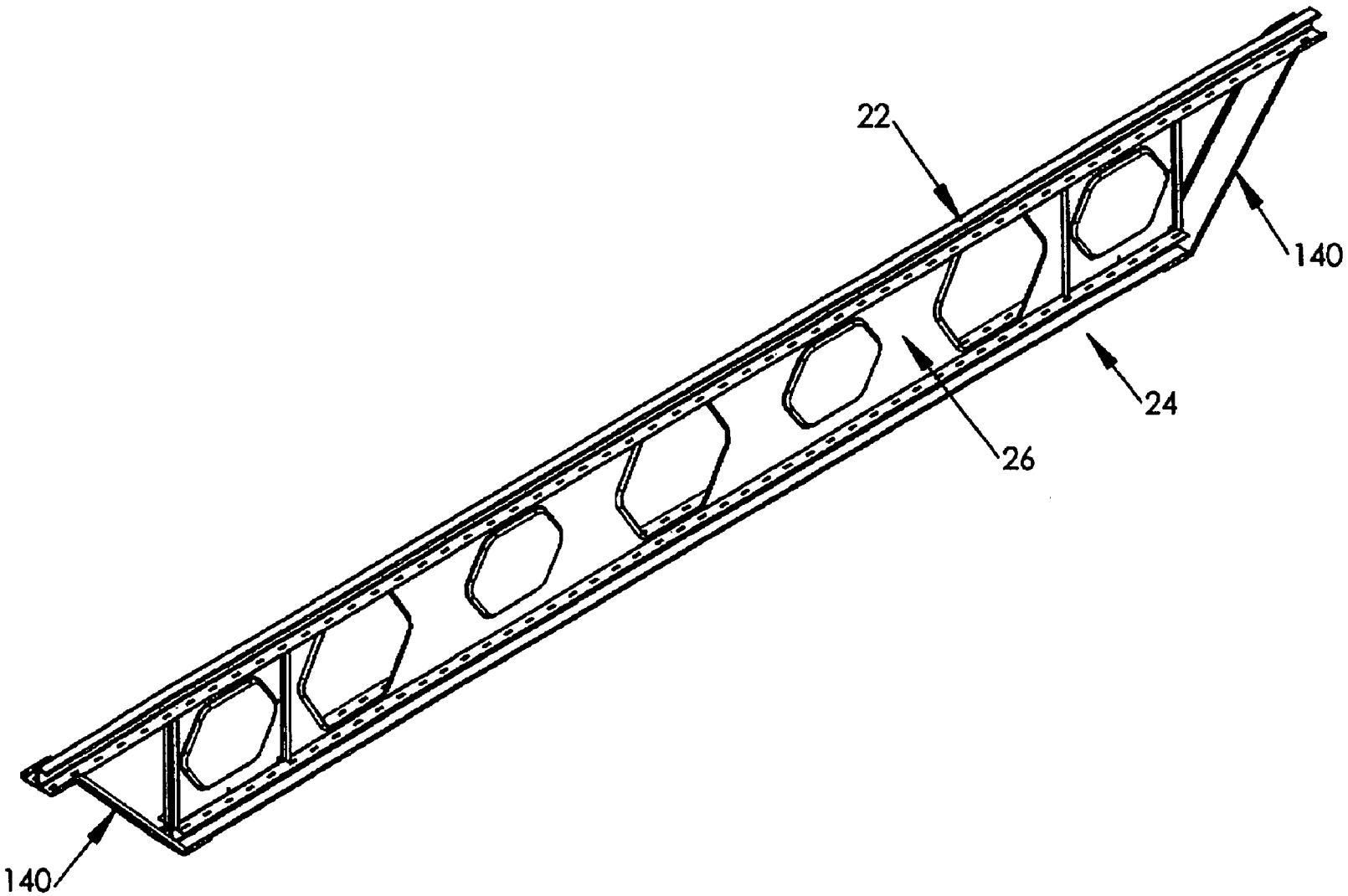
FIG. 27 is a perspective view of a top chord bearing composite version of another embodiment of the invention.
Figure 29:
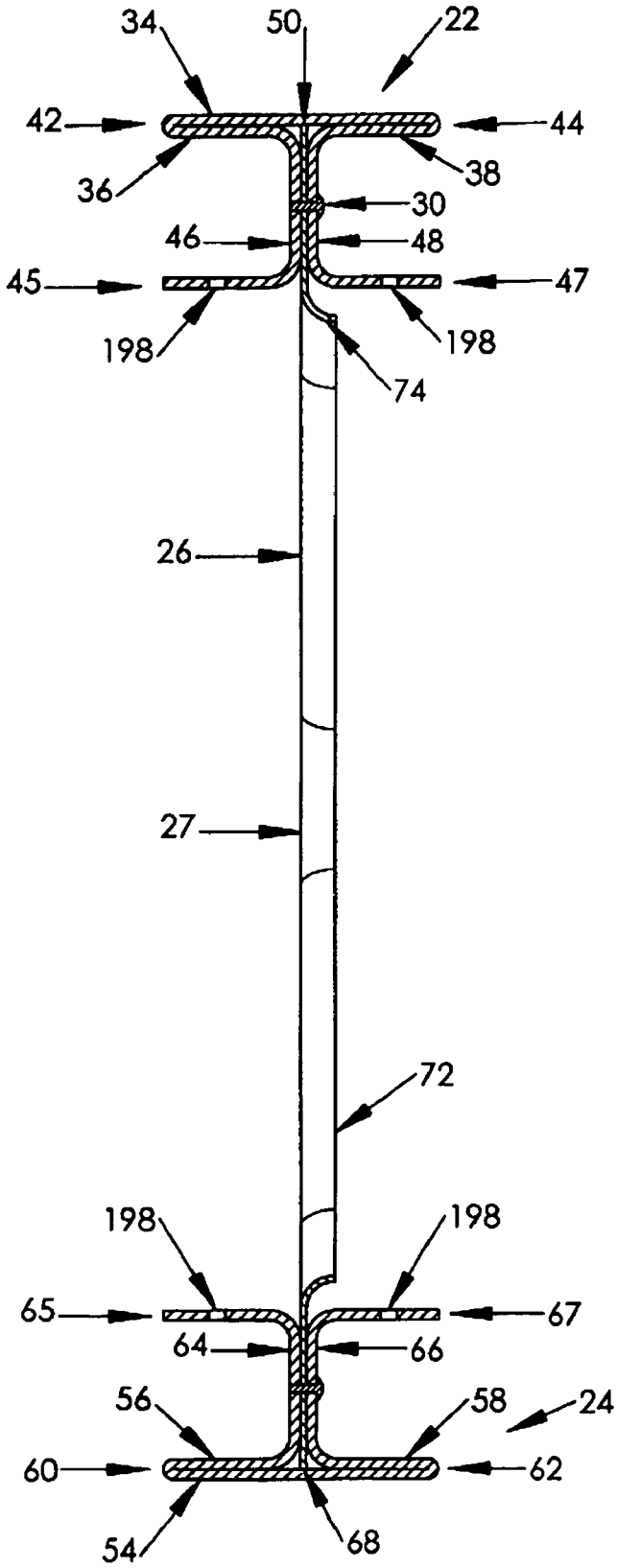
FIG. 29 is a cross section view through the line 116-116 of FIG. 14.

Accordingly the joist fabricated herein can be coated with a variety of paint colours which are painted prior to fabrication so as to produce a variety of joists having different colours and avoiding the dip painting characteristic of open web joist construction. The invention as described herein presents a number of advantages over the prior art. For example, many open web steel joists in the prior art include a cambering of the upper and lower chords 4 and 6 so as to present a slight arch to increase load bearing capabilities of the joist. Such prior art cambering techniques required working against the web during the cambering process. Applicant's invention on the other hand presents an advantage since the upper and lower chord members 22 and 24 can be cambered individually and separately from the web 26. Once the upper and lower chord members 22 and 24 are cambered they can be attached to the web 26 as described since the depth of the said camber is adequately contained within the web receiving tabs 46, 48 of the upper chord and 64, 66 of the lower chord as depicted in FIG. 7. Since the web 26 is not part of the upper and lower chord members 22 and 24 during the cambering process there is substantially less resistance to the cambering. Alternate versions of the invention are shown in FIGS. 14 and 14*a*, FIG. 15, FIG. 29 representing bottom and top chord bearing versions; and FIGS. 26 and 26*a*, and FIG. 27, representing bottom and top chord bearing versions of a composite joist. In FIG. 14 and FIG. 29 a top chord 22 and a bottom chord 24 are attached by web receiving tabs to a generally planar web 26 that defines a Y-axis 27 of the joist by self piercing rivets 30 or other fastening means such as screws or rivets. Said web has longitudinally spaced holes 72 formed therein each with a cold-formed lip 74 for increased rigidity under load to allow the routing of pipes, wiring, ductwork and such of other trades. Further web stiffening may be provided by cold-formed area embossments 184 as shown disposed along the length of the web at locations chosen to counteract applied loads or may be provided by vertical stiffening embossments such as 84 as previously described. Further stiffening at the ends of the joist are provided by embossed plates 101 attached by fasteners 130 to the end portions of the web, and are sized to counter both compressive and shear stresses near the ends of the joist. Such embossed plates may be fastened on both sides of each end of the joist, and may terminate longitudinally in cold-formed flaps 182 that provide increased stiffness and provide a means of attaching joists at their ends.

Figure 33:
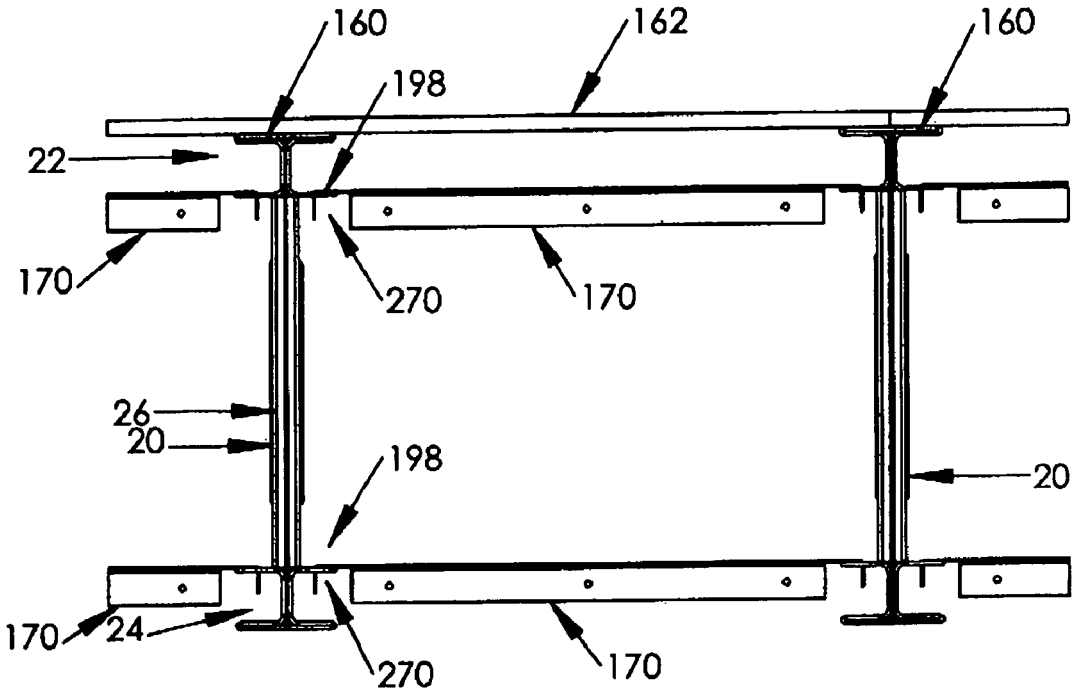
FIG. 33 is a side elevation view of a plurality of another embodiment of the invention with horizontal bridging between joists.
Figure 34:
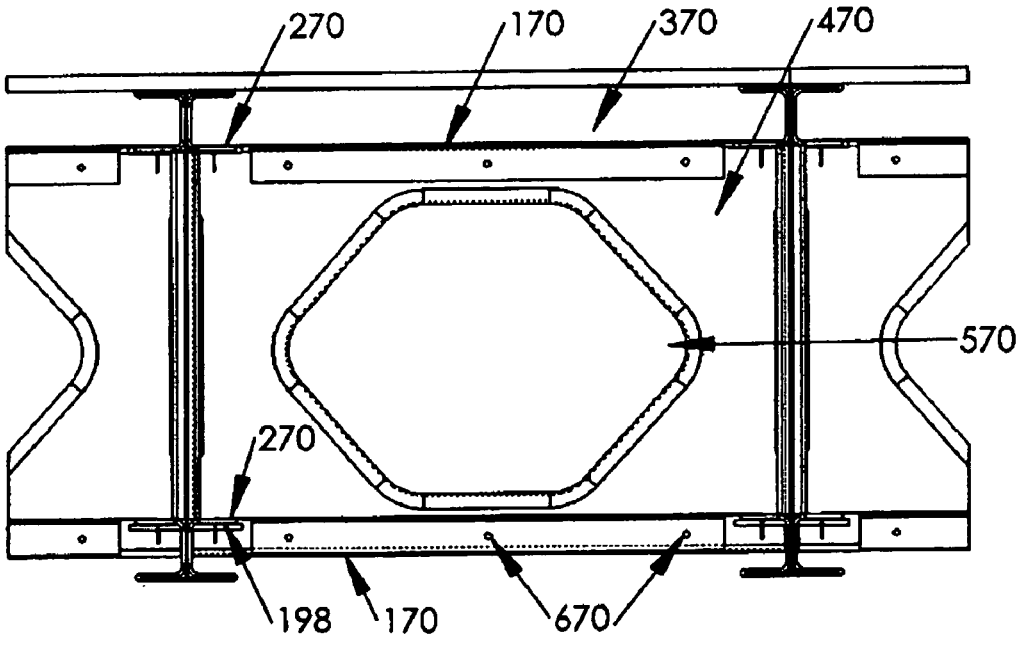
FIG. 34. is a side elevation view of a plurality of another embodiment with diaphragm bridging.

As shown in FIG. 29, the construction of the top chord 22 and the bottom chord 24 of this embodiment may be simplified compared with previously described embodiments. However additional features to those shown previously in FIG. 7 say are disclosed. In particular the web receiving tabs 46 and 48 of the top chord are shown extended and cold-formed to provide outward protruding inner flanges 45 and 47 respectively disposed generally orthoganally to the web 26. Said flanges contribute to the overall strength of the joist; and said flanges are formed with holes 198 regularly spaced along the length of the chord and designed to receive snap-in bridging members as shown in FIGS. 33 and 34. The bottom chord 24 also shows inner flanges 65 and 67 as cold-formed extensions to the receiving tabs 64 and 66. Without loss of generality, FIG. 29 also serves as a cross section view of a top chord bearing version of this embodiment shown in perspective in FIG. 15

Figure 32:
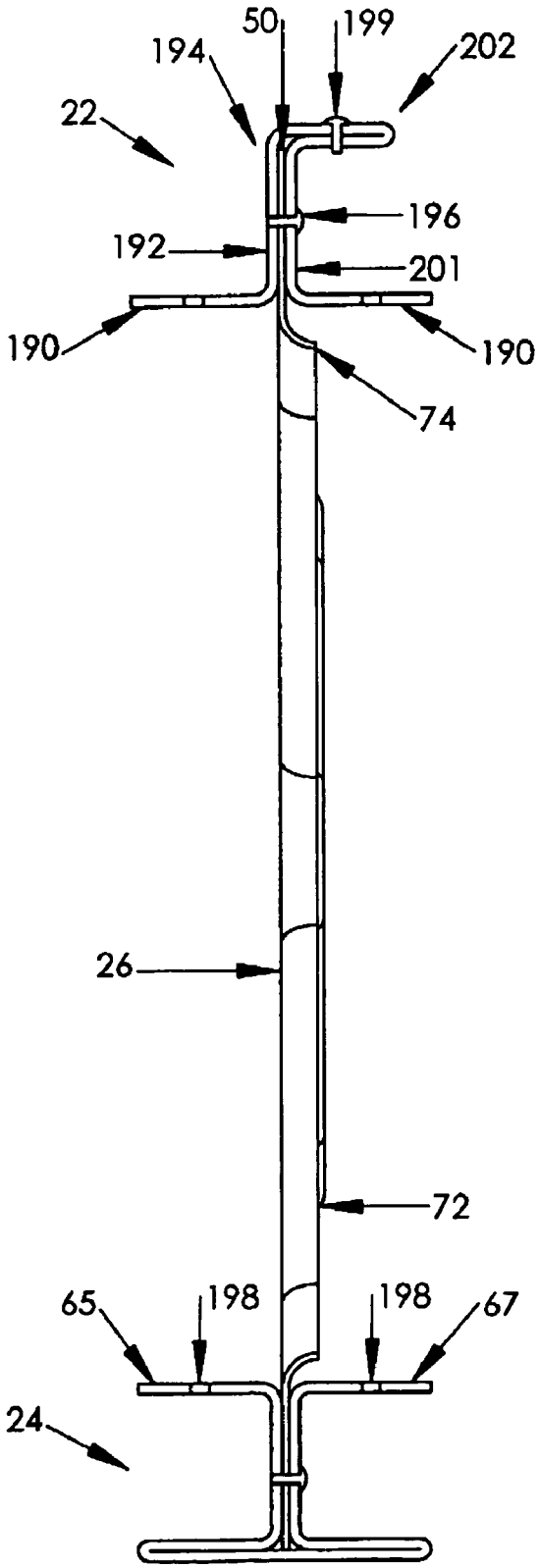
FIG. 32 is a cross sectional view through line 112-112 of FIG. 26.

Perspectives of bottom and top chord bearing composite joist versions of this embodiment are shown in FIGS. 26, 26*a* and FIG. 27, and a cross section view through line 112-112 is shown in FIG. 32. In FIG. 32, top chord 22 is attached to the web 26 by fastening tabs 192 and 201 of vertical section 194 by self piercing rivets 196 or other means. The double thickness of steel forming horizontal extension 202 are fastened by rivets 199 as shown or by other fastening means, with the head of said rivet disposed above the top surface of extension 202 in order to increase the surface area on the top surface of extension 202 and so enhance shear bonding with concrete. The bottom chord inner flanges 65 and 67 are formed with regularly spaced holes 198 to receive snap-in bridging members as shown generally in FIGS. 33 and 34.

Figure 40:
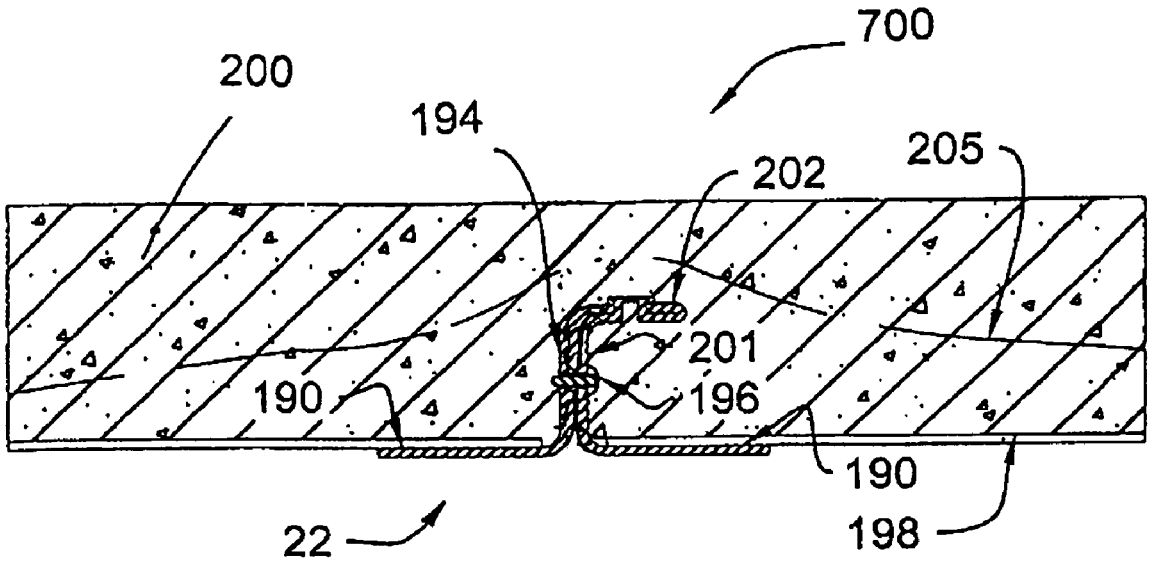
FIG. 40 is a cross sectional view of an alternate embodiment of a cold formed joist in a composite floor or roof structure

An alternate embodiment is shown in FIG. 40 which is similar to the embodiment shown in FIG. 12. In this embodiment the joist 700 only includes a top chord 22 and does not include a web or a bottom chord. It will be appreciated by those skilled in the art that this joist would only have application in relatively short spans. Joist 700 includes a concrete engaging extension 202 which includes a vertical extension 194 that extends upwardly from horizontal upper chord extensions 190. As described above steel deck 198 is adapted to rest on the top surface of the horizontal upper chord extensions 190. A wire mesh 205 is added and thereafter concrete 200 is poured onto the deck 198.

A structural assembly comprising a plurality of joists 20 partially shown at FIG. 33 can define a supporting surface 160 to support a platform 162 such as a roof or floor. Each of the joists 20 as shown in cross section comprises of spaced cold-formed steel upper and lower chord members 22 and 24 and a steel web 26 fastened between upper and lower chord members 22 and 24. A plurality of bridging members 170 is used to stiffen the assembly 20, said bridging members being disposed parallel to the support surface; and said flanges may be connected to adjacent joists at the holes 198 provided by the inner flanges 45 and 47 of the top chord 22 and by the inner flanges 65 and 67 of the bottom chord 24. Bridging members may be constructed from a length of steel of angled cross section terminated at each end by a feature 270 that fits the holes 198 and allows the bridging member to be snap fastened to inner flanges of adjacent joists.

A further aspect of this invention is illustrated in FIG. 34 partially showing a structural assembly of joists 20 defining a support surface 160 supporting a platform 162 such as a floor or roof when both parallel and criss-cross bridging is required. Such combined bridging may be provided by a diaphragm assembly 370 comprising a steel plate 470 affixed by fasteners 670 to upper and lower bridging members 170 each terminated by a snap-in feature 270 at either end. Said steel plate may provide a hole 570 having a cold-formed lip to allow the passage of wiring, pipes and ducting from other trades. Diaphragm assembly 370 providing both parallel and criss-cross bridging may be snap-fastened to adjacent joists by engaging the snap-in feature 270 with the holes 198 provided in the inner flanges of the upper and lower chords.

The snap-in bridging illustrated in FIGS. 33 and 34 advances the prior art by substantially reducing the labour and cost involved in the manual assembly of bridging on the construction site. And although FIGS. 33 and 34 refer to conventional floor or roof structures, the same bridging means may be used without any loss of generality to the construction of composite steel-concrete floors and roofs.

The support structures described in this invention can be utilized either as floor joists or roof joists for single family residential, multi-family residential, commercial or industrial building construction. Further it will be appreciated by those skilled in the art that the system described herein may be used as a stay in place forming system. Analysis and testing of said structures demonstrate that the prior art is advanced in several regards including:

- more economical bottom chord bearing cold-formed steel joists with spans up to 40 feet
- more economical top chord bearing joists capable of mass manufacture and customization
- more effective and economical composite floor and roof structures.

Although the joist embodiments as well as the manufacturing operations and use in construction have been specifically described in relation to the drawings, it should be understood that variations in these embodiments could be achieved by a person skilled in the art without departing from the spirit of the invention as claimed herein. As used herein, the terms "comprises" and "comprising" are to be construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

It will be appreciated that the above description related to the invention by way of example only. Many variations on the invention will be obvious to those skilled in the art and such obvious variations are within the scope of the invention as described herein whether or not expressly described.

What is claimed as the invention is:

1. An upper chord bearing joist comprising:

an upper elongate chord member being cold-formed from a unitary piece of sheet steel and including an upper bearing portion integrally formed with at least one lower bearing extension so as to produce a rigid member, the upper bearing portion being folded over the at least one lower bearing extension so that a bottom surface of the upper bearing portion directly contacts a top surface of the at least one lower bearing extension to reduce a width to thickness ratio of the rigid member, and an integral web receiving portion orthogonal thereto and having two integral web receiving tabs and a pair of integral inner flange portions, each inner flange portion extending substantially perpendicularly from one of the web receiving tabs so as to be in a spaced relationship to the rigid member along a length of the upper, chord member, wherein the upper bearing portion, the at least one lower bearing extension, the two web receiving tabs, and the pair of inner flange portions are a unitary structure made from sheet steel;

a lower elongate chord member, wherein the upper chord member extends longitudinally beyond the lower chord member at each end thereof; and a generally planar steel web attached to the web receiving portion of the upper chord member between the two web receiving tabs and attached to the lower chord member.

2. An upper chord bearing joist as claimed in claim 1 wherein the lower elongate chord member is cold-formed from a unitary piece of sheet steel-and including a lower bearing portion integrally formed with at least one upper bearing extension so as to produce a rigid member, the lower bearing portion being folded over the at least one upper bearing extension to reduce a width to thickness ratio of the rigid member, and an integral web receiving portion orthogonal thereto and having two integral web receiving tabs and a pair of integral inner flange portions, each inner flange portion-extending substantially perpendicularly from one of the web receiving tabs so as to be in a spaced relationship to the rigid member along a length of the lower chord member, wherein the lower bearing portion, the at least one upper bearing extension, the two web receiving tabs, and the pair of inner flange portions are a unitary structure made from sheet steel.

3. An upper chord bearing joist as claimed in claim 2 wherein the generally planar steel web is attached intermediate to the web receiving tabs of the upper and lower chord members between the respective two web receiving tabs.

4. An upper chord bearing joist as claimed in claim 3 further including a pair of angled end support members attached between the ends of the lower chord member and the upper chord member at each end thereof.

5. An upper chord bearing joist as claimed in claim 2 wherein the lower chord extends outwardly from both sides of the web and forms a generally planar bottom surface.

6. An upper chord bearing joist as claimed in claim 1 wherein the lower chord extends outwardly from one side of the web and forms a generally planar bottom surface.

7. An upper chord bearing joist as claimed in claim 1 wherein the lower chord member has a generally planar bottom surface.

8. An upper chord bearing joist as claimed in claim 7 wherein the upper chord member has a generally planar top surface.

9. An upper chord bearing joist as claimed in claim 1 wherein the upper chord member is adapted to be embedded in composite with concrete when the joist is used as a composite joist.

10. An upper chord bearing joist as claimed in claim 9 wherein the upper chord member includes a generally inverted L-shape having a generally vertical portion and a generally horizontal portion and wherein the vertical portion is at least one of the web receiving tabs and wherein the horizontal portion is at least a portion of the rigid member and has at least two thicknesses of steel.

11. An upper chord bearing joist as claimed in claim 2 wherein the inner flange portions have a plurality of spaced apart holes formed therein.

12. An upper chord bearing joist as claimed in claim 1 wherein the joist is configured to be loaded concentrically.

13. An upper chord bearing joist as claimed in claim 1 wherein the web is a cold-formed web having a plurality of holes formed therein.

14. An upper chord bearing joist as claimed in claim 13 wherein each hole has a cold-formed lip extending around the periphery thereof.

15. An upper chord bearing joist as claimed in claim 3 wherein the web includes a plurality of web members attached together.

16. An upper chord bearing joist as claimed in claim 15 wherein the web members are web segments and at least one web segment has a different thickness than the other web segments.

17. An upper chord bearing joist as claimed in claim 15 wherein the web members at opposed ends of the joist have a greater thickness than the web members therebetween.

18. An upper chord bearing joist as claimed in claim 1 wherein the web further includes stiffening means.

19. An upper chord bearing joist as claimed in claim 18 wherein the stiffening means includes a plurality of shapes embossed therein, and wherein the shapes are chosen from a group including vertical ridges and shapes having horizontal and vertical dimension.

20. An upper chord bearing joist as claimed in claim 18 wherein the web includes a plurality of segments and wherein the stiffening means includes stiffening tabs being elongate tabs at either end of each segment.

21. An upper chord bearing joist as claimed in claim 1 wherein each chord member and the web is coated with a coating material.

22. An upper chord bearing joist as claimed in claim 1 wherein the joist is cambered.

23. An upper chord bearing joist as claimed in claim 1 wherein the at least one lower bearing extension includes a pair of opposing lower bearing extensions.

24. A supporting system for use between opposing walls comprising:

a plurality of upper chord bearing joists, each joist having:

an upper elongate chord bearing member being cold-formed from a unitary piece of sheet steel and including an upper bearing portion integrally formed with at least one lower bearing extension so as to produce a rigid member, the upper bearing portion being folded over the at least one lower bearing extension so that a bottom surface of the upper bearing portion directly contacts a top surface of the at least one lower bearing extension to reduce a width to thickness ratio of the rigid member, and an integral web receiving portion orthogonal thereto and having two integral web receiving tabs and a pair of integral inner flange portions, each inner flange portion extending substantially perpendicularly from one of the web receiving tabs so as to be in a spaced relationship to the rigid member along a length of the upper chord member, wherein the upper bearing portion, the at least one lower bearing extension, the two web receiving tabs and the pair of inner flange portions are a unitary structure made from sheet steel, a lower elongate chord member, wherein the upper chord member extends longitudinally beyond the lower chord member at each end thereof, and a generally planar steel web attached to the web receiving portion of the upper chord member between the two web receiving tabs and attached to the lower chord member, wherein the joists are supported by and span a separation between opposing walls.

25. A supporting system as claimed in claim 24 further including a plurality of bridging members between adjacent joists and attached thereto.

26. A supporting system as claimed in claim 25 wherein the plurality of bridging members are adapted to snap in place.

27. A supporting system as claimed in claim 26 wherein the bridging members include a top bridge attached to the webs of joists adjacent to the upper chord and a bottom bridge attached to the webs of the joists adjacent to the lower chord.

28. A supporting system as claimed in claim 26 wherein the bridging members include a top bridge attached to the upper chord of joists and a bottom bridge attached to the lower chord of the joists.

29. A supporting system as claimed in claim 27 further including criss-crossed bridges attached to the top and bottoms bridges.

30. A supporting system as claimed in claim 28 further including criss-crossed bridges attached to the top and bottoms bridges.

31. A supporting system as claimed in claim 25 wherein the bridging members are diaphragm assemblies.

32. A supporting system as claimed in claim 25 wherein the rigid member of the upper chord members are adapted to support one of a platform and a deck.

33. A supporting system as claimed in claim 29 wherein the upper chord member is cold-formed to provide a concrete engaging portion extending upwardly from the top of the flange portion, and the concrete engaging portion is adapted to bond to concrete when the joist is used as a composite joist and wherein the deck includes a composite concrete slab and the plurality of joists together act as a stay in place forming system.

34. A supporting system as claimed in claim 33 wherein the concrete slab has a wire mesh embedded therein.

35. A supporting system as claimed in claim 24 wherein the at least one lower bearing extension includes a pair of opposing lower bearing extensions.

36. A supporting system as claimed in claim 24 wherein the upper chord member is adapted to be embedded in composite with concrete when the joist is used as a composite joist.

37. A supporting system as claimed in claim 36 wherein the upper chord member includes a generally inverted L-shape having a generally vertical portion and a generally horizontal portion and wherein the vertical portion is at least one of the web receiving tabs and wherein the horizontal portion is at least a portion of the rigid member and has at least two thicknesses of steel.

38. An upper chord bearing joist comprising:

an upper elongate chord member being cold-formed from a unitary piece of sheet steel, the upper chord member including an upper bearing portion integrally formed with at least one lower bearing extension so as to produce a rigid member, the upper bearing portion being folded over the at least one lower bearing extension so that a bottom surface of the upper bearing portion directly contacts a top surface of the at least one lower bearing extension to reduce a width to thickness ratio of the rigid member and an integral web receiving portion orthogonal thereto, and having two integral web receiving tabs, wherein the upper bearing portion, the at least one lower bearing extension, and the web receiving portion are a unitary structure made from sheet steel;

a lower elongate chord member, wherein the upper chord member extends longitudinally beyond the lower chord member at each end thereof; and a generally planar steel web attached to the web receiving portion of the upper chord member between the two web receiving tabs and attached to the lower chord member, and the web having a plurality of generally planar web members attached together.

39. An upper chord bearing joist as claimed in claim 38 wherein the web members are web segments and at least one web segment has a different thickness than the other web segments.

40. An upper chord bearing joist as claimed in claim 38 wherein the web members at opposed ends of the joist have a greater thickness than the web members therebetween.

41. An upper chord bearing joist as claimed in claim 38 wherein the web further includes stiffening means.

42. An upper chord bearing joist as claimed in claim 41 wherein the stiffening means includes a plurality of shapes embossed therein wherein the shapes are chosen from a group consisting of vertical ridges and shapes having a horizontal and a vertical dimension.

43. An upper chord bearing joist as claimed in claim 41 wherein the web includes a plurality of segments and wherein the stiffening means includes stiffening tabs being elongate tabs at either end of each segment.

44. An upper chord bearing joist as claimed in claim 38 further including a pair of angled end support members attached between the ends of the lower chord member and the upper chord member at each end thereof.

45. An upper chord bearing joist as claimed in claim 38 wherein the joist is cambered.

46. An upper chord bearing joist as claimed in claim 38 wherein the joist is configured to be loaded concentrically.

47. An upper chord bearing joist as claimed in claim 38 wherein the web has a plurality of holes formed therein.

48. An upper chord bearing joist as claimed in claim 47 wherein each hole has a lip extending around the periphery thereof.

49. An upper chord bearing joist as claimed in claim 38 wherein each chord member and the web is coated with coating material.

50. An upper chord bearing joist as claimed claim 38 wherein the web is attached to each chord using one of rivets, self piercing rivets, bolts and nuts, screws, welding and spot clinches.

51. An upper chord bearing joist as claimed in claim 38 wherein the at least one lower bearing extension includes a pair of opposing lower bearing extensions.

52. An upper chord bearing joist as claimed in claim 38 wherein the upper chord member is adapted to be embedded in composite with concrete when the joist is used as a composite joist.

53. An upper chord bearing joist as claimed in claim 52 wherein the upper chord member includes a generally inverted L-shape having a generally vertical portion and a generally horizontal portion and wherein the vertical portion is at least one of the web receiving tabs and wherein the horizontal portion is at least a portion of the rigid member and has at least two thicknesses of steel.

* * * * *